US011555490B2

(12) United States Patent
Noh et al.

(10) Patent No.: US 11,555,490 B2
(45) Date of Patent: Jan. 17, 2023

(54) LINEAR COMPRESSOR

(71) Applicant: LG Electronics Inc., Seoul (KR)

(72) Inventors: Kiwon Noh, Seoul (KR); Kyunyoung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 271 days.

(21) Appl. No.: 16/457,484

(22) Filed: Jun. 28, 2019

(65) Prior Publication Data

US 2020/0003200 A1 Jan. 2, 2020

(30) Foreign Application Priority Data

Jun. 29, 2018 (KR) ..... 10-2018-0075759

(51) Int. Cl.
*F04B 39/12* (2006.01)
*F04B 35/04* (2006.01)

(52) U.S. Cl.
CPC ..... *F04B 39/121* (2013.01); *F04B 35/045* (2013.01)

(58) Field of Classification Search
CPC .... F04D 35/04; F04D 35/045; F04D 39/0027; F04D 39/0055; F04D 39/0061; F04D 39/14; F04D 39/121; F25B 2400/073; F04B 35/04; F04B 35/045; F04B 39/0027; F04B 39/0055; F04B 39/0061; F04B 39/14; F04B 39/121; F04B 39/12; F04B 39/123
USPC ..... 417/415–417
See application file for complete search history.

(56) References Cited

U.S. PATENT DOCUMENTS 6,824,365 B2 * 11/2004 Park ..... F04B 39/0061 181/403
8,057,200 B2 * 11/2011 Kang et al. ..... F04B 39/0055 417/571
2015/0377531 A1 * 12/2015 Lee et al. ..... F04B 39/122 62/473
2016/0017876 A1 * 1/2016 Kim ..... F04B 35/045 417/443

(Continued)

FOREIGN PATENT DOCUMENTS

EP 2977608 1/2016
EP 3196460 7/2017

(Continued)

OTHER PUBLICATIONS

Extended European Search Report in European Application No. 19183199.9, dated Oct. 7, 2019, 10 pages.

(Continued)

*Primary Examiner* — Charles G Freay
*Assistant Examiner* — Chirag Jariwala
(74) *Attorney, Agent, or Firm* — Fish & Richardson P.C.

(57) ABSTRACT

The present invention relates to a linear compressor. A discharge unit of the linear compressor according to an aspect of the present invention includes a discharge cover coupled with the frame. In addition, the discharge cover includes a cover flange portion and a chamber portion. At this time, the cover flange portion includes a flange main body having a main body penetration portion and a main body extension portion provided outward in a radial direction so as to face the main body penetration portion, and a flange coupling portion having a flange coupling hole into which a fastening member for coupling with the frame is inserted.

12 Claims, 12 Drawing Sheets

(56) References Cited

U.S. PATENT DOCUMENTS

| | | | | |
|---|---|---|---|---|
| 2016/0017878 | A1* | 1/2016 | Kim | F04B 39/126<br>417/437 |
| 2017/0321674 | A1* | 11/2017 | Ha et al. | F04B 35/045 |
| 2018/0051683 | A1* | 2/2018 | Hahn | F04B 39/0022 |
| 2018/0238313 | A1* | 8/2018 | Hahn | F04B 39/0061 |

FOREIGN PATENT DOCUMENTS

| | | |
|---|---|---|
| EP | 3244064 | 11/2017 |
| EP | 3553314 | 5/2020 |
| KR | 1020020077953 | 10/2002 |
| KR | 1020170124908 | 11/2017 |
| KR | 1020180041018 | 4/2018 |

OTHER PUBLICATIONS

Office Action in European Appln. No. 19183199.9, dated Dec. 9, 2021, 7 pages.

* cited by examiner

LINEAR COMPRESSOR

CROSS-REFERENCE TO RELATED APPLICATION

This application claims the priority benefit of Korean Patent Application No. 10-2018-0075759, filed on Jun. 29, 2018, in the Korean Intellectual Property Office, the disclosure of which is incorporated herein by reference in its entirety.

FIELD

The present invention relates to a linear compressor.

BACKGROUND

Generally, a compressor is a mechanical device that receives power from a power generating device such as an electric motor or a turbine to increase pressure by compressing air, refrigerant, or various other operating gases and is widely used over the appliances or the industry as a whole.

Such compressors may be broadly classified into reciprocating compressors, rotary compressors, and scroll compressors.

The reciprocating compressor has a compression space in which a working gas is suctioned or discharged between a piston and a cylinder so that the piston linearly reciprocates within the cylinder to compress the refrigerant.

In addition, the rotary compressor has a compression space in which a working gas is suctioned or discharged between a roller and a cylinder which are eccentrically rotated, and the roller compresses the refrigerant while eccentrically rotating along the inner wall of the cylinder.

In addition, the scroll compressor has a compression space in which a working gas is suctioned or discharged between an orbiting scroll and a fixed scroll, and the orbiting scroll rotates along the fixed scroll to compress the refrigerant.

In recent years, a linear compressor has been developed in which the piston is directly connected to a driving motor which reciprocates linearly in the reciprocating compressor, and the compression efficiency can be improved without mechanical loss due to motion switching and is configured with a simple structure.

In the linear compressor, the piston is linearly reciprocated in the cylinder by the linear motor in the closed shell, and is configured to suction and compress the refrigerant, and then discharge the refrigerant.

At this time, the linear motor is configured such that a permanent magnet is positioned between an inner stator and an outer stator, and the permanent magnet is driven to reciprocate linearly by the mutual electromagnetic force between the permanent magnet and the inner (or outer) stator. As the permanent magnet is driven in a state of being connected to the piston, the piston linearly reciprocates within the cylinder, suctions the refrigerant, compresses the refrigerant, and discharges the refrigerant.

In relation to a linear compressor having such a structure, the present applicant has filed the related art document 1.

RELATED ART 1

1. Publication No. 10-2017-0124908 (Publication date: Nov. 13, 2017)
2. Title of the Invention: Linear compressor The permanent magnet and the piston move according to the structure described in the above-described related art document 1, and the refrigerant can be compressed. Specifically, the suction refrigerant flows into the compression chamber through the piston port and is compressed by the movement of the piston. The compressed high-temperature refrigerant is discharged to the outside of the shell through the discharge chamber formed in the discharge cover.

At this time, the linear compressor according to the related art document 1 has the following problems.

(1) Due to the compressed high-temperature refrigerant, the discharge cover and the frame are overheated, and heat is transferred from the frame to the piston and the cylinder. Particularly, the frame, the piston, and the cylinder are disposed in a state of being in contact with each other so that the heat of the frame can be easily transferred to the piston and the cylinder by conduction.

(2) In addition, the discharge cover is entirely coupled to the front surface of the frame. Accordingly, the frame has a relatively small area exposed to the inside of the shell and does not perform sufficient heat exchange with the refrigerant positioned inside the shell. In other words, there is a problem that heat of the frame is not radiated to the refrigerant positioned inside the shell.

(3) As described above, as the frame is overheated, the heat transferred to the piston and the cylinder overheats the suction refrigerant. Accordingly, there is a problem that the volume of the suction refrigerant is increased and the compression efficiency is lowered.

SUMMARY

The present invention is proposed so as to solve these problems, and an objective of the present invention is to provide a linear compressor in which the area of a frame covered by a discharge cover is minimized.

In particular, an objective of the present invention is to provide a linear compressor in which the shape of the discharge cover is changed so as to minimize the contact area with the frame.

In addition, an objective of the present invention is to provide a linear compressor in which conduction heat transfer to a piston and a cylinder is minimized and the convection heat transfer into the shell is maximized due to the frame whose area covered by the discharge cover is minimized.

According to an aspect of the present invention, there is provided a linear compressor including: a cylinder configured to form a compression space of a refrigerant; a frame in which the cylinder is accommodated; and a discharge unit configured to form a discharge space for the refrigerant through which the refrigerant discharged from the compression space flows. In addition, the discharge unit includes a discharge cover coupled with the frame. In addition, the discharge cover includes a cover flange portion which is seated on a front surface of the frame in an axial direction; and a chamber portion extending forward in the cover flange portion in the axial direction. At this time, the cover flange portion includes a flange main body having a main body penetration portion configured to form a circular opening and a main body extension portion provided outward in a radial direction so as to face the main body penetration portion; and a flange coupling portion having a flange coupling hole into which a coupling member for coupling with the frame is inserted, and at least a portion of the flange coupling portion is positioned outward of the flange main body in the radial direction.

In addition, the main body penetration portion may form an opening having a flange inner diameter L1, and the main body extension portion may form a circular outer appearance having a flange outer diameter L2. At this time, the flange main body may be provided in a ring shape having the flange inner diameter L1 and the flange outer diameter L2 in the radial direction.

In addition, the flange coupling portion may include a coupling penetration portion configured to form an opening having the flange inner diameter L1 together with the main body penetration portion; and a coupling extension portion extending outward from the coupling penetration portion in the radial direction and configured to form the flange fastening hole. At this time, the coupling extension portion may extend further outward than the main body extension portion in the radial direction.

The linear compressor according to the embodiment of the present invention having the above-described configurations has the following effects.

The heat transferred to the refrigerant suctioned into the linear compressor is minimized, and the compression efficiency due to the overheating of the suction gas can be prevented.

Particularly, by radiating the heat of the piston and the cylinder, which raise the temperature of the refrigerant being suctioned, to the outside through the frame, there are advantages that the heat transferred to the refrigerant suctioned from the piston and the cylinder is minimized and the temperature of the suctioned refrigerant is lowered, and the can improve the compression efficiency.

Further, there is an advantage that the surface area of the frame covered by the discharge cover is minimized, and conduction heat transfer from the discharge cover to the frame can be reduced. Further, there is an advantage that the surface area of the frame exposed to the refrigerant in the space inside the shell is increased, and the convection heat transfer (heat radiation) is increased by the refrigerant in the shell.

In addition, there is an advantage that at least a portion of the discharge cover is removed, and the material cost of the discharge cover is thereby reduced, in order to minimize an area which is in contact with the frame.

DETAILED DESCRIPTION

Figure 1:
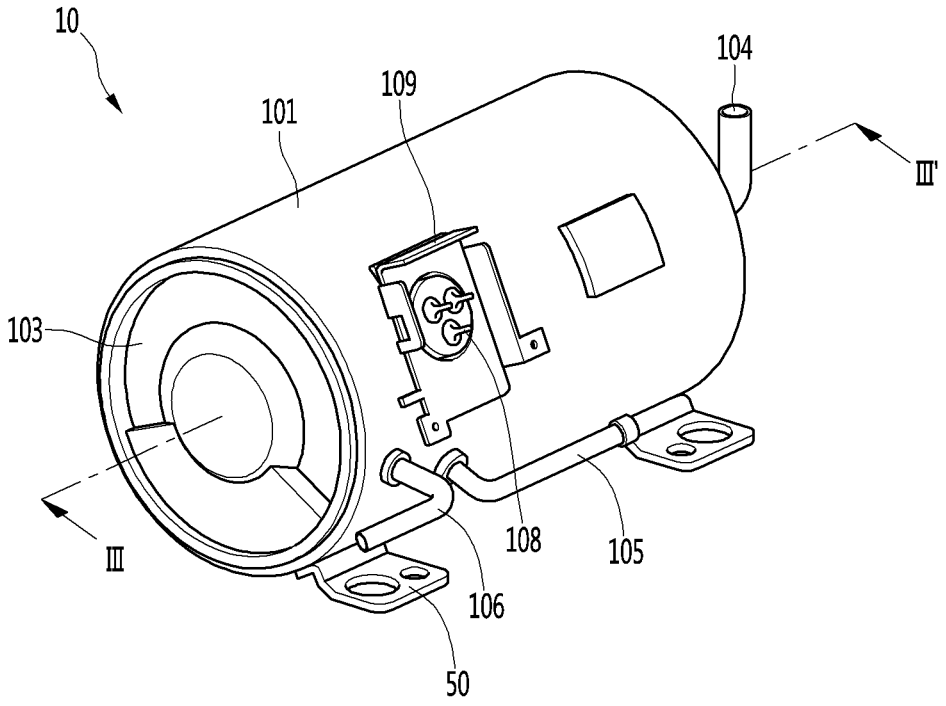
FIG. 1 is a view illustrating a linear compressor according to an embodiment of the present invention.

Hereinafter, some embodiments of the present invention will be described in detail with reference to exemplary drawings. It should be noted that, in adding reference numerals to the constituent elements of the drawings, the same constituent elements are denoted by the same reference symbols as possible even if they are illustrated in different drawings. In addition, in the description of the embodiments of the present invention, the detailed description of related known configurations or functions will be omitted in a case where it is determined that a detailed description of related known configurations or functions hinders understanding of the embodiments of the present invention.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

FIG. 1 is a view illustrating a linear compressor according to an embodiment of the present invention.

As illustrated in FIG. 1, a linear compressor 10 according to an embodiment of the present invention includes a shell 101 and shell covers 102 and 103 coupled to the shell 101. In a broad sense, the shell covers 102 and 103 can be understood as one configuration of the shell 101.

On the lower side of the shell 101, the legs 50 can be coupled. The legs 50 may be coupled to a base of the product on which the linear compressor 10 is installed. For example, the product may include a refrigerator, and the base may include a machine room base of the refrigerator. As another example, the product may include an outdoor unit of the air conditioner, and the base may include a base of the outdoor unit.

The shell 101 has a substantially cylindrical shape and can achieve an arrangement in which the shell lies in a lateral direction or an arrangement in which the shell lies in an axial direction. With reference to FIG. 1, the shell 101 may be elongated in a transverse direction and may have a somewhat lower height in a radial direction. In other words, since the linear compressor 10 can have a low height, for example, there is an advantage that, when the linear compressor 10 is installed in the base of the machine room of the refrigerator, the height of the machine room can be reduced.

In addition, the longitudinal center axis of the shell 101 coincides with the center axis of the compressor main body, which will be described later, and the central axis of the compressor main body coincides with the central axis of the cylinder and the piston constituting the compressor main body.

A terminal 108 may be installed in an outer surface of the shell 101. The terminal 108 is understood as a configuration for transmitting external power to the motor assembly 140

(see FIG. 3) of the linear compressor. In particular, the terminal 108 may be connected to a lead wire of the coil 141*c* (see FIG. 3).

On the outside of the terminal 108, a bracket 109 is provided. The bracket 109 may include a plurality of brackets surrounding the terminal 108. The bracket 109 may function to protect the terminal 108 from an external impact or the like.

Both side portions of the shell 101 are configured to be opened. On both side portions of the opened shell 101, the shell covers 102 and 103 can be coupled. Specifically, the shell covers 102 and 103 includes a first shell cover 102 (see FIG. 3) coupled to one side portion of the shell 101 which is opened and a second shell cover 103 coupled to the other side portion of the shell 101 which is opened. By the shell covers 102 and 103, the inner space of the shell 101 can be sealed.

With reference to FIG. 1, the first shell cover 102 may be positioned on the right side portion of the linear compressor 10 and the second shell cover 103 may be positioned on the left side portion of the linear compressor 10. In other words, the first and second shell covers 102 and 103 may be disposed to face each other. Further, it can be understood that the first shell cover 102 is positioned on the suction side of the refrigerant, and the second shell cover 103 is positioned on the discharge side of the refrigerant.

The linear compressor 10 further includes a plurality of pipes 104, 105, and 106 which are provided in the shell 101 or the shell covers 102 and 103 to suck, discharge, or inject refrigerant.

The plurality of pipes 104, 105, and 106 includes a suction pipe 104 for allowing refrigerant to be suctioned into the linear compressor 10, a discharge pipe 104 for discharging the compressed refrigerant from the linear compressor 10, and a process pipe 106 for replenishing the refrigerant to the linear compressor 10.

For example, the suction pipe 104 may be coupled to the first shell cover 102. The refrigerant can be suctioned into the linear compressor 10 along the axial direction through the suction pipe 104.

The discharge pipe 105 may be coupled to the outer circumferential surface of the shell 101. The refrigerant suctioned through the suction pipe 104 can be compressed while flowing in the axial direction. The compressed refrigerant can be discharged through the discharge pipe 105. The discharge pipe 105 may be disposed at a position adjacent to the second shell cover 103 than the first shell cover 102.

The process pipe 106 may be coupled to the outer circumferential surface of the shell 101. The operator can inject the refrigerant into the linear compressor 10 through the process pipe 106.

The process pipe 106 may be coupled to the shell 101 at a different height from the discharge pipe 105 to avoid interference with the discharge pipe 105. The height is understood as a distance in the vertical direction from the legs 50. The discharge pipe 105 and the process pipe 106 are coupled to the outer circumferential surface of the shell 101 at different heights from each other, and thus operational convenience can be improved.

At least a portion of the second shell cover 103 may be positioned adjacent to the inner circumferential surface of the shell 101, corresponding to the point where the process pipe 106 is coupled. In other words, at least a portion of the second shell cover 103 may act as a resistance of the refrigerant injected through the process pipe 106.

Therefore, from the viewpoint of the flow passage of the refrigerant, the flow passage size of the refrigerant flowing through the process pipe 106 is reduced by the second shell cover 103 while the refrigerant enters the inner space of the shell 101, and is formed to be large again while the refrigerant passes through the shell. In this process, the pressure of the refrigerant can be reduced to vaporize the refrigerant, and in this process, the oil fraction contained in the refrigerant can be separated. Therefore, the refrigerant compression performance can be improved while the oil fraction-separated refrigerant flows into the interior of the piston 130 (see FIG. 3). The oil fraction can be understood as operating oil present in the cooling system.

A device for supporting a compressor main body disposed inside the shell 101 may be provided inside the first and second shell covers 102 and 103. Here, the compressor main body refers to a component provided inside the shell 101 and may include, for example, a driving portion for reciprocating in the front and rear direction and a support portion supporting the driving portion.

Hereinafter, the compressor main body will be described in detail.

Figure 2:
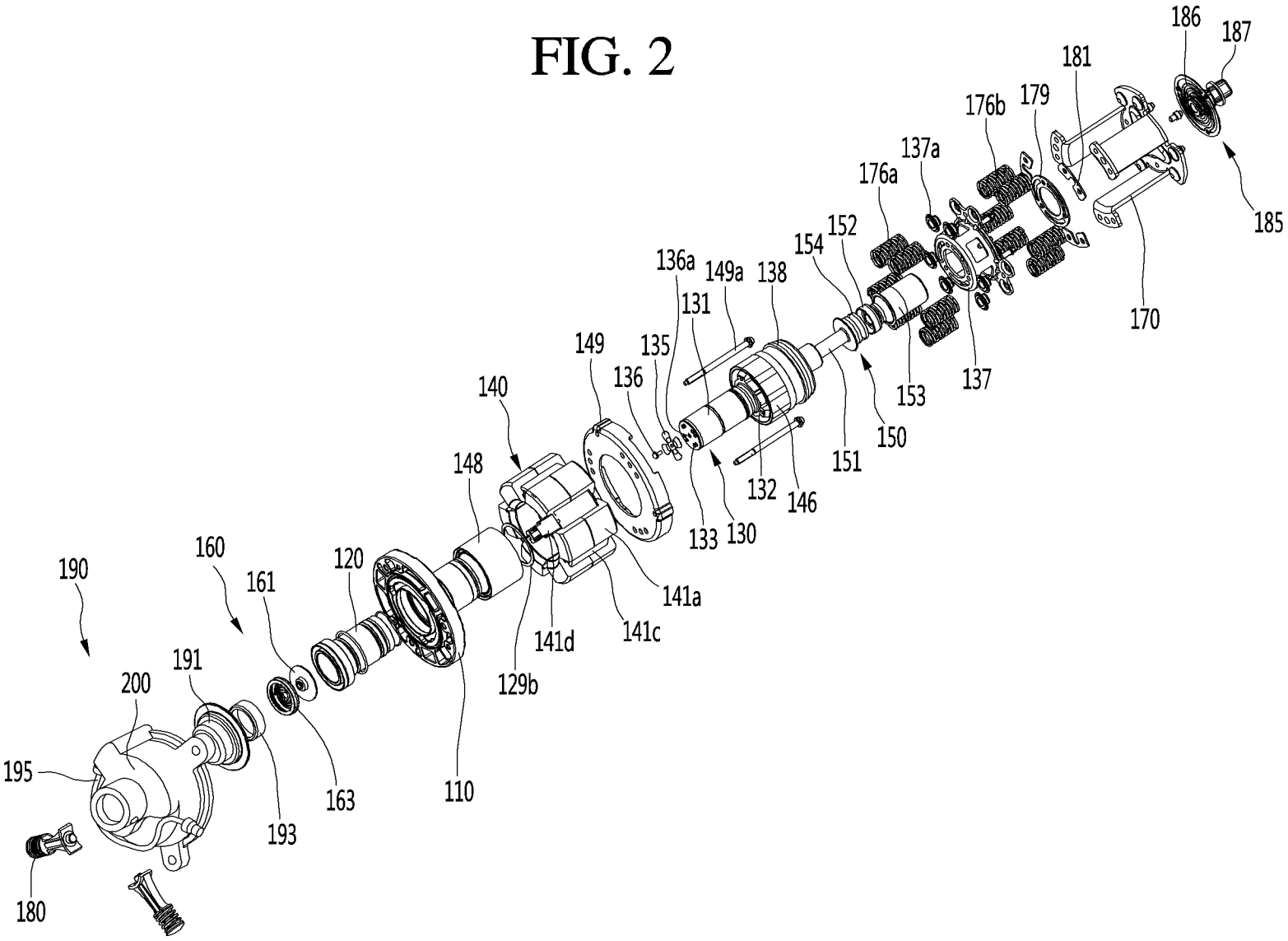
FIG. 2 is an exploded view of an internal configuration of the linear compressor according to an embodiment of the present invention.
Figure 3:
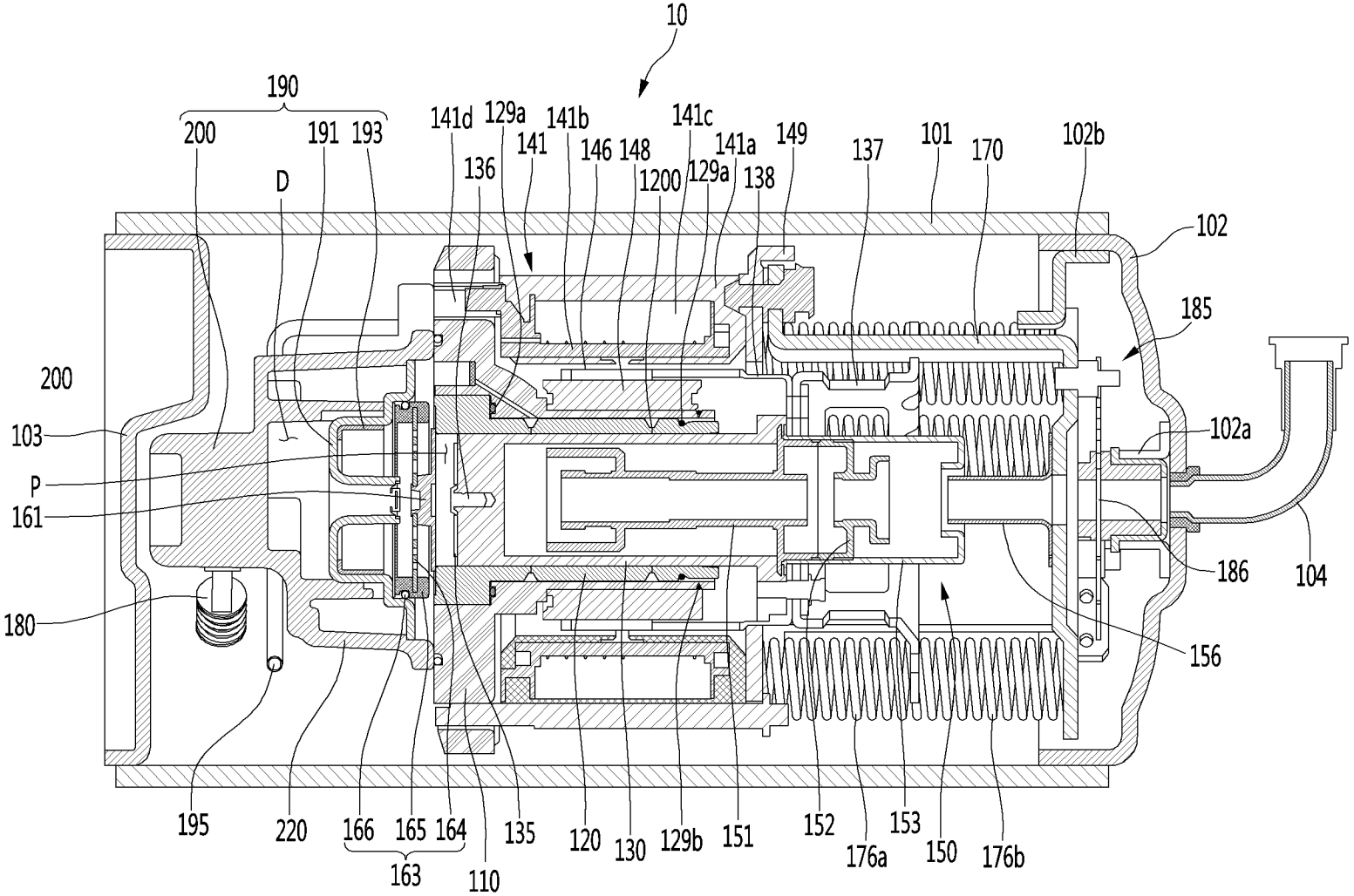
FIG. 3 is a sectional view taken along line of FIG. 1.

FIG. 2 is an exploded view of an internal configuration of the linear compressor according to an embodiment of the present invention, and FIG. 3 is a sectional view taken along line III-III' of FIG. 1.

With reference to FIGS. 2 and 3, the linear compressor 10 according to the embodiment of the present invention includes a frame 110, a cylinder 120, a piston 130 reciprocating linearly in the cylinder 120, a motor assembly 140, as a linear motor which applies a driving force to the piston 130. When the motor assembly 140 is driven, the piston 130 can reciprocate in the axial direction.

Hereinafter, a direction is defined.

The term "axial direction" can be understood as a direction in which the piston 130 reciprocates, that is, a lateral direction in FIG. 3. In addition, among these "axial directions", a direction from the suction pipe 104 toward the compression space P, that is, a direction in which the refrigerant flows is referred to as "front direction" and the opposite direction is defined as "rear direction". When the piston 130 moves forward, the compression space P can be compressed.

On the other hand, "radial direction" can be understood as a direction perpendicular to the direction in which the piston 130 reciprocates and a vertical direction of FIG. 3. The direction away from the central axis of the piston 130 is defined as 'outside' and the direction approaching the central axis of the piston 130 as 'inside'. The central axis of the piston 130 may coincide with the central axis of the shell 101, as described above.

The frame 110 is understood as a configuration for fixing the cylinder 120. The frame 110 is disposed to surround the cylinder 120. In other words, the cylinder 120 may be positioned to be accommodated inside the frame 110. For example, the cylinder 120 may be press-fitted into the inside of the frame 110. In addition, the cylinder 120 and the frame 110 may be made of aluminum or an aluminum alloy.

The cylinder 120 is configured to receive at least a portion of the piston main body 131. In addition, a compression space P in which the refrigerant is compressed by the piston 130 is formed in the cylinder 120.

The piston 130 includes a substantially cylindrical piston main body 131 and a piston flange 132 extending from the piston main body 131 in the radial direction. The piston main body 131 reciprocates within the cylinder 120 and the piston flange 132 can reciprocate outside the cylinder 120.

A suction hole 133 for introducing a refrigerant into the compression space P is formed in a front portion of the piston main body 131, and a suction valve 135 which selectively opens the suction hole 133 is provided on the front of the suction hole 133.

In addition, the front portion of the piston main body 131 is formed with a fastening hole 136*a* to which a predetermined fastening member 136 is coupled. Specifically, the fastening hole 136*a* is positioned at the center of the front portion of the piston main body 131, and a plurality of suction holes 133 are formed to surround the fastening hole 136*a*. In addition, the fastening member 136 is coupled to the coupling hole 136*a* through the suction valve 135 to fix the suction valve 135 to the front portion of the piston main body 131.

The motor assembly 140 includes an outer stator 141 which is fixed to the frame 110 and is disposed so as to surround the cylinder 120, an inner stator 148 which is spaced inward from the outer stator 141, and a permanent magnet 146 which is positioned in the space between the outer stator 141 and the inner stator 148.

The permanent magnets 146 can reciprocate linearly by mutual electromagnetic forces with the outer stator 141 and the inner stator 148. The permanent magnet 146 may be composed of a single magnet having one pole or may be constructed by coupling a plurality of magnets having three poles.

The permanent magnet 146 may be installed on the magnet frame 138. The magnet frame 138 has a substantially cylindrical shape and may be disposed so as to be inserted into a space between the outer stator 141 and the inner stator 148.

In detail, with reference to FIG. 3, the magnet frame 138 is coupled to the piston flange 132, extends outwardly in the radial direction, and can be bent forward. At this time, the permanent magnet 146 may be installed at a front portion of the magnet frame 138. Accordingly, when the permanent magnet 146 reciprocates, the piston 130 can reciprocate axially together with the permanent magnet 146 by the magnet frame 138.

The outer stator 141 includes coil winding bodies 141*b*, 141*c* and 141*d* and a stator core 141*a*. The coil winding body includes a bobbin 141*b* and a coil 141*c* wound in the circumferential direction of the bobbin.

The coil winding body further includes a terminal portion 141*d* for guiding the power line connected to the coil 141*c* to be drawn out or exposed to the outside of the outer stator 141. The terminal portion 141*d* may be inserted into a terminal insertion port 1104 provided in the frame 110.

The stator core 141*a* includes a plurality of core blocks formed by stacking a plurality of laminations in a circumferential direction. The plurality of core blocks may be disposed to surround at least a portion of the coil winding body 141*b* and 141*c*.

A stator cover 149 is provided at one side of the outer stator 141. In other words, one side portion of the outer stator 141 may be supported by the frame 110 and the other side portion thereof may be supported by the stator cover 149.

In addition, the linear compressor 10 further includes a cover fastening member 149*a* for fastening the stator cover 149 and the frame 110 to each other. The cover fastening member 149*a* may extend forward toward the frame 110 through the stator cover 149 and may be coupled to the stator fastening hole 1102 of the frame 110.

The inner stator 148 is fixed to the outer periphery of the frame 110. The inner stator 148 is formed by laminating a plurality of laminations in the circumferential direction from the outside of the frame 110.

In addition, the linear compressor 10 further includes a suction muffler 150 which is coupled to the piston 130 and reduces noise generated from the refrigerant suctioned through the suction pipe 104. The refrigerant suctioned through the suction pipe 104 flows into the piston 130 through the suction muffler 150. For example, in the course of the refrigerant passing through the suction muffler 150, the flow noise of the refrigerant can be reduced.

The suction muffler 150 includes a plurality of mufflers 151, 152 and 153. The plurality of mufflers includes a first muffler 151, a second muffler 152 and a third muffler 153, which are coupled to each other.

The first muffler 151 is positioned inside the piston 130 and the second muffler 152 is coupled to the rear side of the first muffler 151. The third muffler 153 accommodates the second muffler 152 therein and may extend to the rear of the first muffler 151. The refrigerant suctioned through the suction pipe 104 can pass through the third muffler 153, the second muffler 152, and the first muffler 151 in this order from the viewpoint of the flow direction of the refrigerant. In this process, the flow noise of the refrigerant can be reduced.

Further, the suction muffler 150 further includes a muffler filter 154. The muffler filter 154 may be positioned at an interface between the first muffler 151 and the second muffler 152. For example, the muffler filter 154 may have a circular shape, and the outer periphery of the muffler filter 154 may be supported between the first and second mufflers 151 and 152.

In addition, the linear compressor 10 further includes a supporter 137 for supporting the piston 130. The supporter 137 is coupled to the rear side of the piston 130 and the muffler 150 is formed to pass through the supporter 137. Further, the piston flange 132, the magnet frame 138, and the supporter 137 may be fastened by a fastening member.

A balance weight 179 may be coupled to the supporter 137. The weight of the balance weight 179 can be determined based on the operating frequency range of the compressor main body. In addition, the supporter 137 may be coupled with a spring support portion 137*a* coupled to a first resonance spring 176*a* to be described later.

In addition, the linear compressor 10 further includes a rear cover 170 which is coupled to the stator cover 149 and extends rearward. The rear cover 170 includes three support legs, and the three support legs can be coupled to the rear surface of the stator cover 149.

Further, a spacer 181 may be disposed between the three support legs and the rear surface of the stator cover 149. The distance from the stator cover 149 to the rear end portion of the rear cover 170 can be determined by adjusting the thickness of the spacer 181. The rear cover 170 may be spring-supported to the supporter 137.

In addition, the linear compressor 10 further includes an inflow guide portion 156 coupled to the rear cover 170 to guide the inflow of refrigerant into the muffler 150. At least a portion of the inflow guide portion 156 may be inserted into the suction muffler 150.

In addition, the linear compressor 10 further includes a plurality of resonance springs 176*a* and 176*b* whose natural frequencies are adjusted so that the piston 130 can resonate. The plurality of resonance springs 176*a* and 176*b* include a first resonance spring 176*a* supported between the supporter 137 and the stator cover 149 and a second resonance spring 176*b* supported between the supporter 137 and the rear cover 170.

By the action of the plurality of resonance springs 176*a* and 176*b*, stable movement of the driving portion reciprocating in the linear compressor 10 is performed, and the generation of vibration or noise caused by the movement of the driving portion can be reduced.

In addition, the linear compressor 10 includes a discharge unit 190 and a discharge valve assembly 160.

The discharge unit 190 forms a discharge space D for the refrigerant discharged from the compression space P. The discharge unit 190 includes a discharge cover 200 coupled to the front surface of the frame 110 and a discharge plenum 191 disposed inside the discharge cover 200. In addition, the discharge unit 190 may further include a cylindrical fixing ring 193 which is in close contact with the inner circumferential surface of the discharge plenum 191.

The discharge valve assembly 160 is coupled to the inside of the discharge unit 190 and discharges refrigerant compressed in the compression space P to the discharge space D. In addition, the discharge valve assembly 160 may include a spring assembly 163 which provides an elastic force in a direction in which the discharge valve 161 and the discharge valve 161 are in close contact with the front end of the cylinder 120.

The spring assembly 163 includes a valve spring 164 in the form of a leaf spring, a spring support 165 positioned at the edge of the valve spring 164 to support the valve spring 164, and a friction ring 166 fitted to the outer circumferential surface of the spring support 165.

The front central portion of the discharge valve 161 is fixedly coupled to the center of the valve spring 164. The rear surface of the discharge valve 161 is brought into close contact with the front surface (or the front end) of the cylinder 120 by the elastic force of the valve spring 164.

When the pressure in the compression space P becomes equal to or higher than the discharge pressure, the valve spring 164 is elastically deformed toward the discharge plenum 191. The discharge valve 161 is spaced from the front end portion of the cylinder 120 so that the refrigerant can be discharged from the discharge space D (or discharge chamber) formed in the discharge plenum 191 in the compression space.

In other words, in a case where the discharge valve 161 is supported on the front surface of the cylinder 120, the compression space P is maintained in a closed state, and in a case where the discharge valve 161 is separated from the front surface of the cylinder 120, the compressed space P is opened so that the compressed refrigerant in the compression space P can be discharged.

The compression space P can be understood as a space formed between the suction valve 135 and the discharge valve 161. The suction valve 135 is formed on one side of the compression space P and the discharge valve 161 may be provided on the other side of the compression space P, that is, on the opposite side of the suction valve 135.

When the pressure in the compression space P becomes equal to or lower than the suction pressure of the refrigerant in the process of linearly reciprocating the piston 130 in the cylinder 120, the suction valve 135 is opened and enters the compression space P.

On the other hand, when the pressure in the compression space P becomes equal to or higher than the suction pressure of the refrigerant, the suction valve 135 is closed and the refrigerant in the compression space P is compressed by advancing the piston 130.

Meanwhile, when the pressure in the compression space P is larger than the pressure (discharge pressure) in the discharge space D, and the discharge valve 161 is separated from the cylinder 120 while the valve spring 164 is deformed forward. The refrigerant in the compression space P is discharged into the discharge space D formed in the discharge plenum 191 through the space between the discharge valve 161 and the cylinder 120.

When the discharge of the refrigerant is completed, the valve spring 164 provides a restoring force to the discharge valve 161 so that the discharge valve 161 is brought into close contact with the front end of the cylinder 120 again.

In addition, the linear compressor 10 may further include a cover pipe 195. The cover pipe 195 discharges the refrigerant flowing into the discharge unit 190 to the outside. At this time, one end of the cover pipe 195 is coupled to the discharge cover 200, and the other end thereof is coupled to the discharge pipe 105. In addition, at least a portion of the cover pipe 195 is made of a flexible material and may extend roundly along the inner circumferential surface of the shell 101.

In addition, the linear compressor 10 may further include a pair of first support devices 180 for supporting the front end portion of the main body of the compressor 10. One end of the pair of first support devices 200 is fixed to the discharge unit 190 and the other end thereof is in close contact with the inner circumferential surface of the shell 101. For example, the pair of first support devices 180 can support the discharge unit 190 in an open state at an angle ranging from 90 to 120 degrees.

At this time, the second shell cover 103 may be provided to prevent interference with the first support device 180. In detail, the second shell cover 103 may be formed so that a portion corresponding to the pair of first support devices 180 protrudes axially outward.

In addition, the linear compressor 10 may further include a second support device 185 for supporting a rear end portion of the compressor main body. The second support device 185 includes a second support spring 186 provided in a circular plate spring shape and a second spring support portion 187 fitted to the center portion of the second support spring 186.

The outer edge of the second support spring 186 may be fixed to the rear surface of the rear cover 170 by a fastening member. The second spring support portion 187 is coupled to the cover support portion 102*a* disposed at the center of the first shell cover 102. Accordingly, the rear end of the compressor main body can be elastically supported at the central portion of the first shell cover 102.

In addition, a stopper 102*b* may be provided on the inner edge of the first shell cover 102. The stopper 102*b* is understood as a configuration which prevents the main body of the compressor, particularly, the motor assembly 140 from being damaged by collision with the shell 101 due to shaking, vibration or impact generated during transportation of the linear compressor 10.

In particular, the stopper 102*b* may be positioned adjacent to the rear cover 170. Accordingly, in a case where the linear compressor 10 is shaken, the rear cover 170 interferes with the stopper 102*b*, thereby preventing impact from being directly transmitted to the motor assembly 140.

In addition, the linear compressor 10 includes a plurality of sealing members for increasing a coupling force between the frame 110 and components around the frame 110. The plurality of sealing members may have a ring shape.

In detail, the plurality of sealing members may include a first sealing member 129*a* provided at a portion to which the frame 110 and the cylinder 120 are coupled to each other and a second sealing member 129*b* provided at a portion to which the inner stator 148 is coupled.

Hereinafter, the discharge unit 190 will be described in detail.

Figure 4:
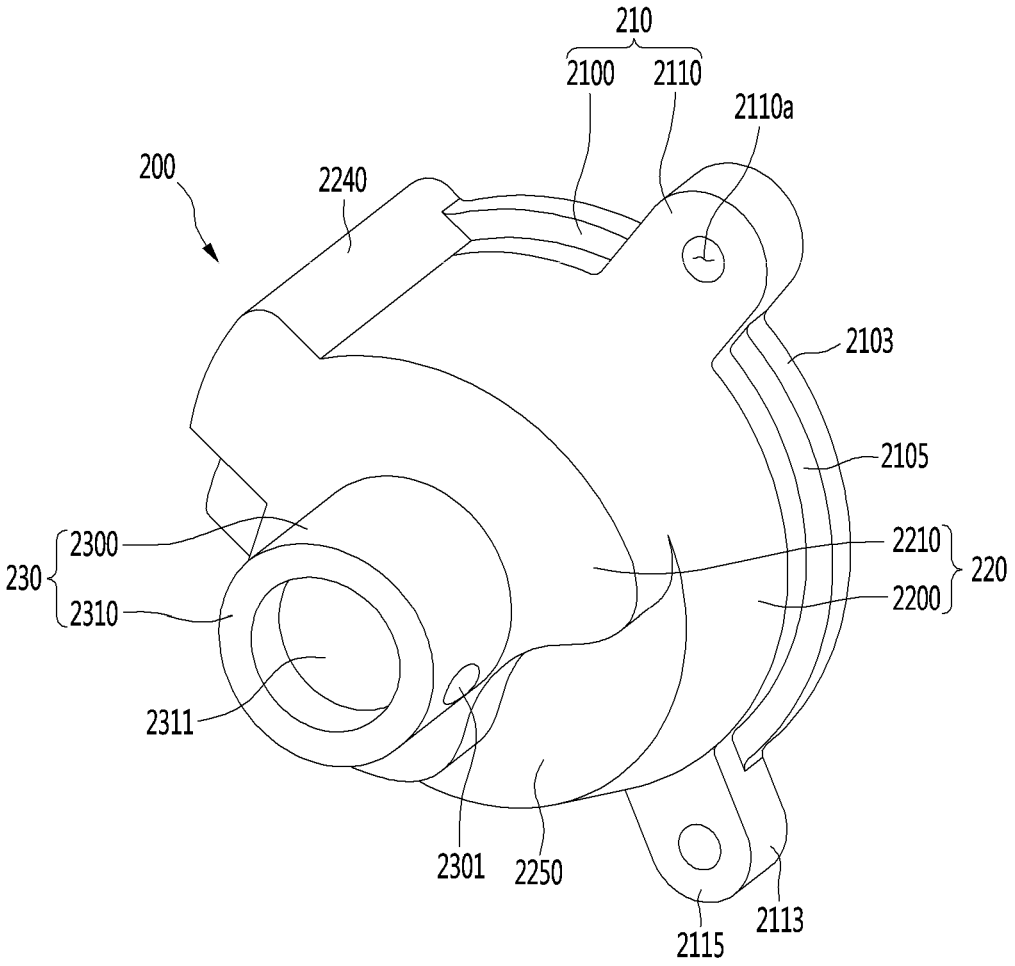
FIGS. 4 and 5 are views illustrating a discharge unit of a linear compressor according to an embodiment of the present invention.
Figure 5:
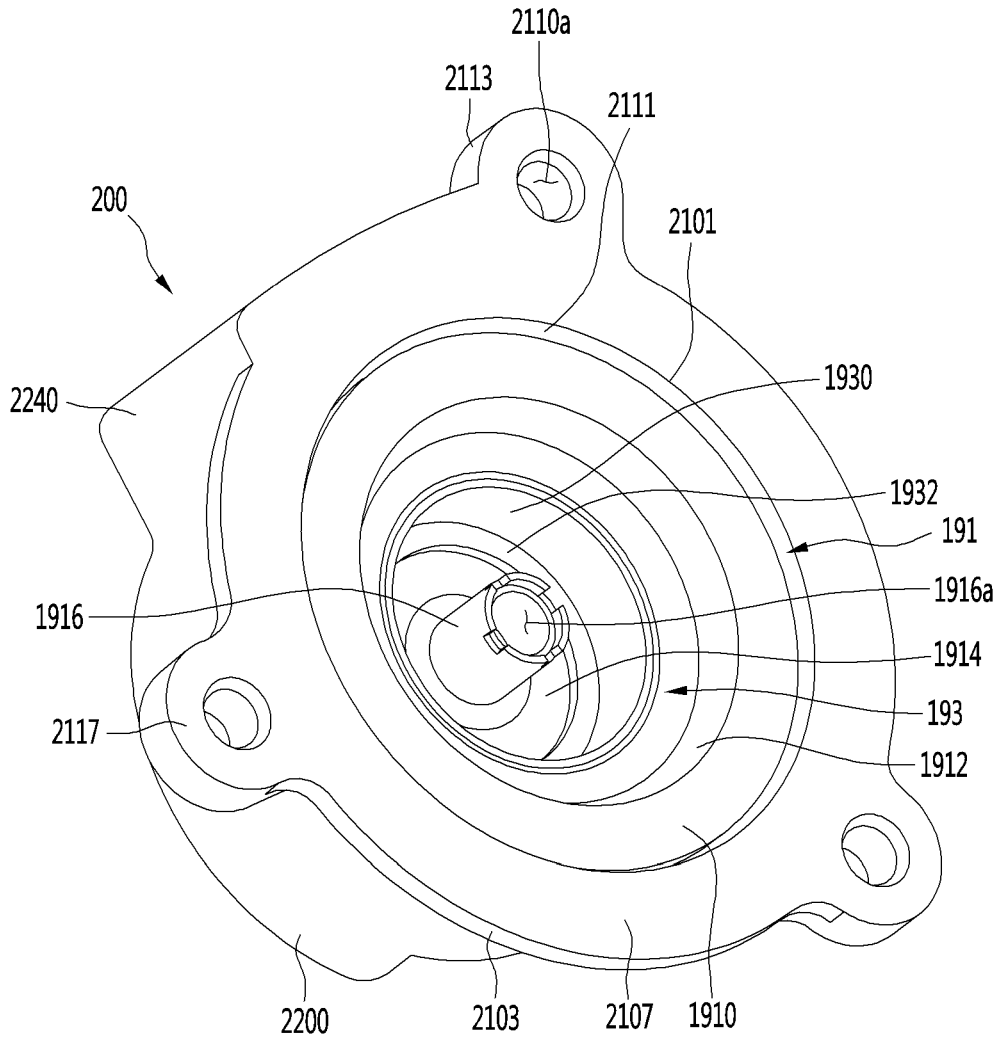
Figure 6:
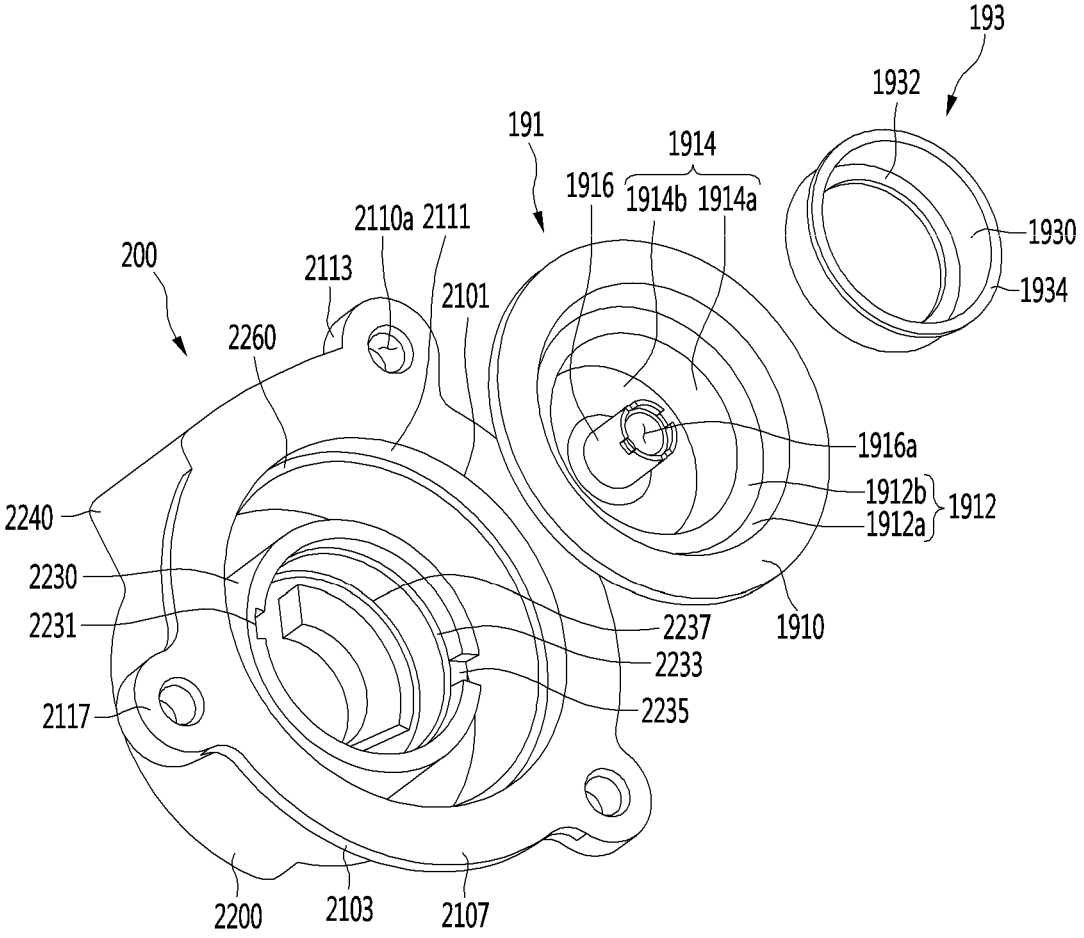
FIG. 6 is an exploded view illustrating a discharge unit of a linear compressor according to an embodiment of the present invention.

FIGS. 4 and 5 are views illustrating a discharge unit of a linear compressor according to an embodiment of the present invention, and FIG. 6 is an exploded view illustrating a discharge unit of a linear compressor according to an embodiment of the present invention.

As illustrated in FIGS. 4 to 6, the discharge unit 190 includes the discharge cover 200, the discharge plenum 191, and the fixing ring 193. The discharge cover 200, the discharge plenum 191, and the fixing ring 193 may be formed of different materials and manufacturing methods from each other.

At this time, the discharge plenum 191 is coupled to the inside of the discharge cover 200, and the fixing ring 193 is coupled to the inside of the discharge plenum 191. Particularly, by the coupling of the discharge cover 200 and the discharge plenum 191, a plurality of discharge spaces D are formed. The discharge space D can be understood as space through which the refrigerant discharged in the compression space P flows.

The discharge cover 200 may be formed in a bowl shape as a whole. In other words, the discharge cover 200 may be provided in a shape in which one surface is opened and internal space is formed. At this time, the discharge cover 200 may be disposed such that the rear in the axial direction is opened. At this time, FIG. 4 illustrates the front of the discharge cover 200 and FIG. 5 and FIG. 6 illustrates the rear of the discharge cover 200.

The discharge cover 200 includes a cover flange portion 210 coupled with the frame 110, a chamber portion 220 extending forward from the cover flange portion 210 in the axial direction, and a support device fixing portion 230 extending forward in the axial direction.

The cover flange portion 210 has a configuration which is in close contact and is coupled to the front surface of the frame 110. Accordingly, the heat of the discharge cover 200 can be conducted to the frame 110 through the cover flange portion 210. Since the thermal conductivity is proportional to the contact area, the amount of heat conducted according to the contact area between the cover flange portion 210 and the frame 110 can be changed. This will be described in detail with reference to FIGS. 8 to 12.

The cover flange portion 210 includes a flange main body 2100 and a flange coupling portion 2110. At this time, the flange main body 2100 and the flange coupling portion 2110 have a predetermined thickness in the axial direction and are formed to extend in the radial direction.

The flange main body 2100 includes a main body penetration portion 2101 which forms a circular opening at the central portion thereof. The main body penetration portion 2101 is understood as an opening formed on one opened surface of the discharge cover 200. In other words, the main body penetration portion 2101 can be understood as a space formed at the outermost portion of the internal space of the discharge cover 200.

Also, the main body penetration portion 2101 can be understood as an opening into which the discharge plenum 191 is inserted. Therefore, the main body penetration portion 2101 may be formed to have a size corresponding to the discharge plenum 191. At this time, the diameter of the opening formed by the main body penetrating portion 2101 is referred to as a flange inner diameter L1. The flange inner diameter L1 can be understood as the inner diameter of the flange main body 2100.

In addition, the flange main body 2100 includes a main body extension portion 2103 which is opposed to the main body penetration portion 2101 in the radial direction. The main body extension portion 2103 is formed in a circular shape as a whole, and the diameter of a circle formed by the main body extension portion 2103 is referred to as a flange outer diameter L2. The flange outer diameter L2 can be understood as the outer diameter of the flange main body 2100.

In summary, the flange main body 2100 may be provided in a ring shape having the flange inner diameter L1 and the flange outer diameter L2 (L2>L1). In addition, the difference between the flange inner diameter L1 and the flange outer diameter L2 may be referred to as a length of the flange main body 2100 in the radial direction.

In addition, the flange main body 2100 includes a main body connection portion 2105 connected to the chamber portion 220 and a main body contact surface 2107 contacting the frame 110.

As described above, the flange main body 2100 has a predetermined thickness in the axial direction, and such a thickness is referred to as a flange main body thickness t1. At this time, The flange main body thickness t1 may be understood as a distance between the main body connection portion 2105 and the main body contact surface 2107.

In other words, the main body connection portion 2105 and the main body abutting surface 2107 correspond to axially opposed surfaces. Particularly, the main body contact surface 2107 is positioned rearward of the main body connection portion 2105 in the axial direction. In addition, the main body contact surface 2107 may be referred to as a rear surface of the flange main body 2100 and the main body connection portion 2105 may be referred to as a front surface of the flange main body 2100.

Therefore, the flange main body 2100 is formed of the main body penetration portion 2101, the main body extension portion 2103, the main body connection portion 2105, and the main body contact surface 2107. In addition, the edge portions where the main body penetration portion 2101, the main body extension portion 2103, the main body connection portion 2105, and the main body contact surface 2107 are connected to each other may be formed to be rounded.

The flange coupling portion 2110 corresponds to a portion coupled to the frame 110 by the fastening member. Accordingly, the flange coupling portion 2110 includes a flange fastening hole 2110*a* through which the coupling member passes.

In addition, a plurality of the flange coupling portions 2110 may be provided for stable coupling with the frame 110. In other words, the plurality of flange coupling portions 2110 extending outward from at least a portion of the main body penetration portion 2101 in the radial direction may be formed. For example, three flange coupling portion 2110 may be formed.

Further, the plurality of flange coupling portions 2110 may be disposed at equal intervals in the circumferential direction. This is because the flange fastening holes 2110*a* formed in the respective flange coupling portions 2110 are positioned at equal intervals in the circumferential direction. Accordingly, the discharge cover 200 can be stably fixed at three points on the frame 110.

Each flange coupling portion 2110 includes a coupling penetration portion 2111 forming an inner surface in the radial direction and a coupling extension portion 2113 extending outwardly from the coupling penetration portion 2111 in the radial direction.

At this time, the coupling penetration portion 2111 together with the main body penetration portion 2101 forms one opening corresponding to the flange inner diameter L1. In other words, it can be understood that the coupling penetration portion 2111 is a portion of the main body penetration portion 2101. In addition, the flange coupling portion 2110 can be understood as a shape extending outward from at least a portion of the main body penetration portion 2101 in the radial direction.

The coupling extension portion 2113 extends from the coupling penetration portion 2111 roundly so as to surround the flange fastening hole 2110*a*. At this time, the flange fastening hole 2110*a* is positioned outward of the flange main body 2100 in the radial direction. In other words, the coupling extension portion 2113 is formed so as to extend further outward than the main body extension portion 2103 in the radial direction.

In other words, the flange coupling portion 2110 according to the present invention extends outwardly of the flange main body 2100 in the radial direction. In other words, at least a portion of the flange coupling portion 2110 is positioned outward the flange outer diameter L2 in the radial direction. Accordingly, the cover flange portion 210 is provided in a ring shape, a portion of which protrudes outward from a ring shape as a whole.

In addition, each flange coupling portion 2110 includes a coupling connection portion 2115 and a coupling contact surface 2117 which is in contact with the frame 110.

As described above, the flange coupling portion 2110 has a predetermined thickness in the axial direction, and such a thickness is referred to as a flange coupling portion thickness t2. At this time, the flange coupling portion thickness t2 can be understood as a distance between the coupling connection portion 2115 and the coupling contact surface 2117.

In other words, the coupling connection portion 2115 and the coupling contact surface 2117 correspond to opposed surfaces in the axial direction. In particular, the coupling contact surface 2117 is positioned axially rearward than the coupling connection portion 2115.

At this time, the coupling contact surface 2117 is positioned on the same plane as the main body contact surface 2107. In other words, the coupling contact surface 2117 and the main body contact surface 2107 form a plane, which is referred to as flange contact surfaces 2107 and 2117. The flange contact surfaces 2107 and 2117 correspond to the surfaces where the flange 110 and the discharge cover 200 are in contact with each other.

Further, the flange coupling portion thickness t2 is provided to be thicker than the flange main body thickness t1. In other words, the coupling connection portion 2115 is positioned above the main body coupling portion 2105 in the axial direction. It can be understood that the flange coupling portion 2110 is a portion coupled by the fastening member and is prevented from being damaged because a relatively large external force is applied.

Accordingly, each flange coupling portion 2110 is formed of the coupling penetration portion 2111, the coupling extension portion 2113, the coupling connection portion 2115, and the coupling contact surface 2117. In addition, the corner portions where the coupling penetration portion 2111, the coupling extension portion 2113, the coupling connection portion 2115, and the coupling contact surface 2117 are connected to each other may be rounded.

Further, a portion where the flange main body 2100 and each flange coupling portion 2110 are connected may be formed so as to be rounded. In particular, the coupling penetration portion 2111 and the main body penetration portion 2101 form one opening, and the coupling contact surface 2117 and the main body contact surface 2107 form one plane. Also, the main body extension portion 2103 and the coupling extension portion 2113 are connected smoothly, and the main body connection portion 2105 and the coupling connection portion 2115 can be connected in a stepped manner.

The chamber portion 220 and the support device fixing portion 230 may be formed into a cylindrical outer appearance. In detail, the chamber portion 220 and the support device fixing portion 230 each have a predetermined outer diameter in the radial direction and extend in the axial direction. At this time, the outer diameter of the support device fixing portion 230 is smaller than the outer diameter of the chamber portion 220.

In addition, the chamber portion 220 and the support device fixing portion 230 are provided in an axially rearward-opened shape. Accordingly, the chamber portion 220 and the support device fixing portion 230 has an outer appearance of a side surface of a cylindrical shape and a front surface of a circular shape.

At this time, an outer appearance of the side surface of the chamber portion 220 is referred to as the chamber outside surface 2200 and an outer appearance of the front surface of the chamber portion 220 is referred to as the chamber front surface 2210. In addition, the outer appearance of the side surface of the support device fixing portion 230 is referred to as a fixing outer surface 2300 and the outer appearance of the front surface of the support device fixing portion 230 is referred to as a fixing front surface 2310.

The chamber portion 220 is formed to extend axially forward in the cover flange portion 210. Specifically, the chamber outer surface 2200 may extend in the axial direction at the main body connection portion 2105 and the coupling connection portion 2115.

At this time, the inside of the chamber outer surface 2200 may be stepped with the main body connection portion 2105 and the coupling connection portion 2115. In detail, the inside of the chamber outer surface 2200 may be formed to have a smaller diameter than the flange inner diameter L2. The portion where the diameter is changed is referred to as a cover stepped portion 2260.

The cover stepped portion 2260 is understood as a configuration in which the discharge plenum 191 is stably mounted. In other words, the discharge plenum 191 may be inserted through the main body penetration portion 2101 and be seated by being caught by the cover stepped portion 2260.

In addition, although it is described that the cover stepped portion 2260 is formed between the chamber portion 220 and the cover flange portion 210, but the cover stepped portion 2260 may be formed on the chamber portion 220 or the cover flange portion 210. In other words, it is sufficient that the cover stepped portion 2260 is formed in the inner space of the discharge cover 200.

In the chamber portion 220, a discharge space D through which refrigerant flows may be provided. Particularly, the chamber portion 220 includes a partition sleeve 2230 for partitioning the inner space of the chamber portion 220.

The partition sleeve 2230 may be formed in a cylindrical shape inside the chamber portion 220. Specifically, the partition sleeve 2230 may extend axially rearward from the chamber front surface 2210.

In addition, the outer diameter of the partition sleeve 2230 is smaller than the outer diameter of the chamber outer surface 2200. Specifically, the partition sleeve 2230 is spaced apart from the chamber outer surface 2200 such that a predetermined space is formed between the partition sleeve 2230 and the chamber outer surface 2200. Therefore, the inner space of the chamber portion 220 can be partitioned by the partition sleeve 2230.

In addition, the discharge plenum 191 can be fitted into the partition sleeve 2230. In detail, at least a portion of the discharge plenum 191 may be inserted into the partition sleeve 2230 so as to be in contact with the inside of the partition sleeve 2230. At this time, the discharge plenum 191 is inserted up to a portion of the partition sleeve 2230 such that a predetermined space is formed between the discharge plenum 191 and the partition sleeve 2230.

Figure 7:
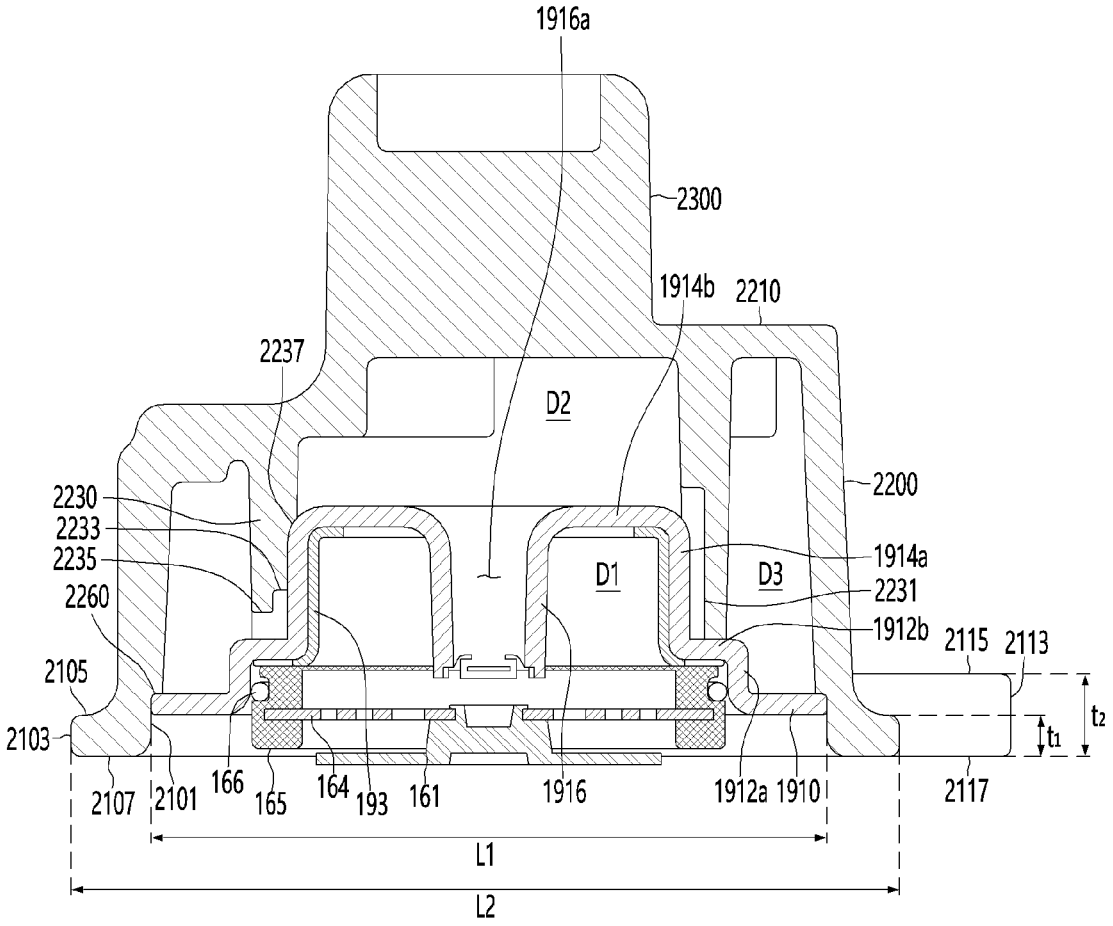
FIG. 7 is a sectional view taken along line VII-VII' of FIG. 4.

At this time, an inner space of the partition sleeve 2230, that is, a space between the partition sleeve 2230 and the discharge plenum 191 is referred to as a second discharge chamber D2 (see FIG. 7). In addition, outer space of the partition sleeve 220, that is, a space between the partition sleeve 2230 and the chamber outer surface 2200 is referred to as a third discharge chamber D3 (see FIG. 7).

In other words, the discharge space D includes the second discharge chamber D2 and the third discharge chamber D3 which are partitioned by the partition sleeve 2230. In addition, the discharge space D includes a first discharge chamber D1 (see FIG. 7) formed by the discharge plenum 191. This will be described later.

In addition, the partition sleeve 2230 may be formed with a first guide groove 2231, a second guide groove 2233, and a third guide groove 2235.

The first guide groove 2231 may be recessed outward from the inner circumferential surface of the partition sleeve 2230 in the radial direction and may extend in the axial direction. Particularly, the first guide groove 2231 is formed so as to extend from a front side in the axial direction to a rear side in the axial direction than the position where the discharge plenum 191 is inserted. Therefore, the refrigerant guided to the second discharge chamber D2 can be moved rearward along the first guide groove 2231 in the axial direction.

The second guide groove 2233 may be recessed outward from the inner circumferential surface of the partition sleeve 2230 in the radial direction and extend in the circumferential direction. Particularly, the second guide groove 2233 is formed on the inner circumferential surface of the partition sleeve 2230 which is in contact with the discharge plenum 191.

In addition, the second guide groove 2233 may be formed to communicate with the first guide groove 2231. Therefore, the refrigerant moved along the first guide groove 2231 can be moved in the circumferential direction along the second guide groove 2233.

The third guide groove 2235 may be formed to be axially forwardly recessed at a rear end portion of the partition sleeve 2230 in the axial direction. Accordingly, the rear end portion of the partition sleeve 2230 may be stepped. In other words, the third guide groove 2235 corresponds to an opening through which the second discharge chamber D2 and the third discharge chamber D3 communicate with each other.

In addition, the third guide groove 2235 may be formed to communicate with the second guide groove 2233. In other words, the third guide groove 2235 may be recessed to the portion where the second guide groove 2233 is formed. Therefore, the refrigerant moved along the second guide groove 2233 can be moved to the third discharge chamber D3 along the third guide groove 2235.

In addition, the third guide groove 2235 and the first guide groove 2231 may be spaced apart from each other in the circumferential direction. For example, the third guide groove 2235 may be formed at a position facing the first guide groove 2231, that is, at a position 180 degrees apart in the circumferential direction.

Accordingly, the second guide groove 2233 connected to the first guide groove 2231 and the third guide groove 2235 may be formed to extend relatively long. Therefore, the time during which the refrigerant flowing into the second guide groove 2233 stays in the second guide groove 2233 can be increased. In this process, the pulsation noise of the refrigerant can be effectively reduced.

In addition, the chamber portion 220 may further include a pipe coupling portion 2240 to which the cover pipe 195 is coupled. In particular, the cover pipe 195 may be coupled to the pipe coupling portion 2240 to communicate with the third discharge chamber D3.

The pipe coupling portion 2240 may protrude outward from the chamber outer surface 2200 in the radial direction. In addition, the pipe coupling portion 2240 may extend in the axial direction from the chamber front surface 2210 to the cover flange portion 210. At this time, the cover pipe 195 may be coupled to the upper side of the pipe coupling portion 2240 in the axial direction.

The shape of the pipe coupling portion 2240 may be understood to be for manufacturing convenience. Accordingly, the pipe coupling portion 2240 may be provided in various forms on the chamber outer surface 2200. In addition, a shape protruding to one side from the cover flange portion 210 is formed by the pipe coupling portion 2240.

In other words, the pipe coupling portion 2240 together with the flange coupling portion 2110 may form a portion protruding in the radial direction from the flange main body 2100. In other words, at least a portion of the pipe coupling portion 2240 may be disposed outwardly of the flange extension 2103 in the radial direction.

In addition, the chamber portion 220 may further include a chamber recessed portion 2250 for avoiding interference with the cover pipe 195 in a state where the cover pipe 195 is coupled to the pipe coupling portion 2240.

The recessed portion 2250 functions to prevent the cover pipe 195 from contacting the chamber front surface 2210 in a case where the cover pipe 195 is coupled to the pipe coupling portion 2240. Therefore, the recessed portion 2250 can be understood as a portion formed by recessing a portion of the chamber front surface 2210 rearward in the axial direction. In other words, the chamber front surface 2210 may be stepped by the recessed portion 2250.

The support device fixing portion 230 is formed to extend axially forward in the chamber portion 220. Specifically, the fixing outer surface 2300 may extend from the chamber front surface 2210 in the axial direction.

The fixing outer surface 2300 is formed with a fixing coupling groove 2301 to which the pair of first support devices 180 are coupled. In detail, a pair of fixing fastening grooves 2301 are provided in correspondence with the pair of first support devices 180.

In addition, a pair of fixing fastening grooves 2301 are spaced from the fixing outer surface 2300 in the circumferential direction. Further, the fixing fastening groove 2301 may be formed by being recessed or penetrated inward from the fixing outer surface 2300 in the radial direction. For example, the fixing fastening groove 2301 may have a circular sectional shape and may extend in the radial direction.

A fixing recessed portion 2311 is formed in the fixing surface 2310. The fixing recessed portion 2311 may be recessed axially rearward from the fixing surface 2310. A support device (not illustrated) in contact with the second shell cover 103 may be mounted on the fixing recessed portion 2311.

At this time, the discharge cover 200 according to an embodiment of the present invention is integrally manufactured by aluminum die casting. Therefore, unlike the discharge cover of the related art, in a case of the discharge cover 200 of the present invention, the welding process can be omitted. Therefore, the manufacturing process of the discharge cover 200 is simplified, resulting in minimization of product defects, and the product cost can be reduced. Further, since there is no dimensional tolerance due to welding, leakage of the refrigerant can be prevented.

Accordingly, the cover flange portion 210, the chamber portion 220, and the support device fixing portion 230 described above are integrally formed and can be understood as being divided for convenience of explanation. In addition, since the respective constitutions of the discharge cover 200 described above are integrally formed, the classification standard may not be clear.

The discharge plenum 191 includes a plenum flange 1910, a plenum seating portion 1912, a plenum main body 1914, and a plenum extension portion 1916. At this time, the discharge plenum 191 may be integrally formed of engineering plastic. In other words, the respective constitutions of the discharge plenum 191 to be described later are distinguished for the convenience of explanation.

In addition, each configuration of the discharge plenum 191 may be formed to have the same thickness. Accordingly, the plenum flange 1910, the plenum seating portion 1912, the plenum main body 1914, and the plenum extension portion 1916 may be formed to extend in the same thickness.

The plenum flange 1910 may be provided in a ring shape having an axial thickness. At this time, the outer diameter of the plenum flange 1910 is set to a size corresponding to the inner diameter L1 thereof. At this time, the correspondence means the outer diameter of the plenum flange 1910 is same as the inner diameter L1 of the flange or the assembly tolerance is taken into consideration in the inner diameter L1 of the plenum flange.

Also, an outer portion of the plenum flange 1910 in the radial direction may be seated in the cover stepped portion 2260. Accordingly, the discharge plenum 191 can be inserted into the discharge cover 200 up to a point where the plenum flange 1910 is in contact with the cover stepped portion 2260.

At this time, the plenum flange 1910 has a function of closing the rear side of the third discharge chamber D3 in the radial direction. In other words, as the plenum flange 1910 is seated on the cover stepped portion 2260, the refrigerant in the third discharge chamber D3 can be prevented from flowing axially rearward.

The inner diameter of the plenum flange 1910 is sized to correspond to the spring assembly 163. In detail, the plenum flange 1910 may extend inward adjacent the outer surface of the spring support portion 165 in the radial direction.

The plenum seating portion 1912 extends inside the plenum flange 1910 so that the spring assembly 163 is seated. In detail, the plenum seating portion 1912 bends and extends forwardly from the inner edge of the plenum flange 1910 in the axial direction and bends and extends again inward in the radial direction.

Therefore, the plenum seating portion 1912 is provided in a cylindrical shape in which one end positioned at the front side in the axial direction as a whole is bent inward in the radial direction. At this time, a portion extending forward from the plenum flange 1910 in the axial direction is referred to as a first plenum seating portion 1912*a*, and a portion extending inward from the first plenum seating portion 1912*a* in the radial direction is referred to as a second plenum seating portion 1912*b*.

The first plenum seating portion 1912*a* extends forward along the outer surface of the spring support portion 165 in the axial direction. At this time, the axial length of the first plenum seating portion 1912*a* may be shorter than the axial length of the outer surface of the spring support portion 165. In other words, at least a portion of the spring support portions 165 is seated on the plenum seating portion 1912.

At this time, the first plenum seating portion 1912*a* is in contact with the friction ring 166. In detail, the friction ring 166 is installed so that at least a portion of the friction ring 166 protrudes from the outer circumferential surface of the spring support portion 165. Accordingly, when the spring assembly 163 is seated on the plenum seating portion 1912, the friction ring 166 is brought into close contact with the first plenum seating portion 1912*a*.

In particular, the friction ring 166 may be formed of an elastic material, such as rubber, whose shape is changed by an external force. Accordingly, the friction ring 166 can prevent a gap from being formed between the outer circumferential surfaces of the first plenum seating portion 1912*a* and the spring support portion 165.

Further, the friction ring 166 can prevent the spring assembly 163 from being idle in the circumferential direction. In addition, since the spring support portion 165 does not directly hit the discharge plenum 191 by the friction ring 166, the generation of the impact noise can be minimized.

The second plenum seating portion 1912*b* extends inward along the front surface of the spring support portion 165 in the radial direction. In addition, the second plenum seating portion 1912*b* abuts against the partition sleeve 2230. In other words, the second plenum seating portion 1912*b* is disposed between the spring support portion 165 and the partition sleeve 2230.

In other words, the partition sleeve 2230 extends rearward from the chamber front 2210 to the second plenum seating portion 1912*b* in the axial direction. At this time, the third seating groove 2235 is recessed on the inner surface of the partition sleeve 2230 to be spaced apart from the second plenum seating portion 1912*b*. Accordingly, the refrigerant may flow between the partition sleeve 2230 formed with the third seating groove 2235 and the second plenum seating portion 1912*b*.

The plenum main body 1914 extends inside the plenum seating portion 1912 to form the first discharge chamber D1. In detail, the plenum main body 1914 is bent and extends forwardly in an axial direction from the inner edge of the second plenum seating portion 1912*b* and is bent and extends again inward in the radial direction.

Therefore, the plenum main body 1914 is provided in a cylindrical shape in which one end positioned at the front side in the axial direction as a whole is bent inward in the radial direction. At this time, a portion extending forward from the plenum main body 1914 in the axial direction is referred to as a first plenum main body 1914*a*, and a portion extending inward from the first plenum main body 1914*a* in the radial direction is referred to as a second plenum main body 1914*b*.

The first plenum main body 1914*a* extends forward along the inner surface of the partition sleeve 2230 in the axial direction. Particularly, the first plenum main body 1914*a* is in close contact with the inner surface of the partition sleeve 2230 so as to prevent the refrigerant from flowing between the first plenum main body 1914*a* and the partition sleeve 2230.

At this time, the first and second seating grooves 2231 and 2233 are recessed in the inner surface of the partition sleeve 2230 to be spaced apart from the first plenum main body 1914*a*. Accordingly, the refrigerant can flow between the partition sleeve 2230 in which the first and second seating grooves 2231 and 2333 are formed and the first plenum main body 1914*a*.

At this time, the axial length of the first plenum main body 1914*a* is shorter than the axial length of the partition sleeve 2230. Accordingly, the second discharge chamber D2 may be formed on the front of the first plenum main body 1914*a* in the axial direction. At this time, a partition stepped portion 2237 on which the upper end of the first plenum main body 1914*a* in the axial direction is seated may be formed on the inner surface of the partition sleeve 2230.

The second plenum main body 1914*b* extends inward in the radial direction at the front end of the first plenum main body 1914*a* in the axial direction. Accordingly, the second discharge chamber D2 is formed in the axial direction of the second plenum main body 1914*b*, and the first discharge chamber D1 is formed rearward in the axial direction. In other words, the second plenum main body 1914*b* can be understood as a wall partitioning the first discharge chamber D1 and the second discharge chamber D2.

At this time, the second plenum main body 1914*b* is provided in a ring shape having the front end in the axial direction of the first plenum main body 1914*a* as the outer diameter. In other words, an opening is formed in the center of the second plenum main body 1914*b*.

The plenum extension portion 1916 extends axially rearward at the inner end portion of the second plenum main body 1914*b* in the radial direction. In other words, the opening formed in the central portion of the second plenum main body 1914*b* extends axially rearward to form a predetermined passage.

As described above, the passage formed by the plenum extension portion 1916 is referred to as a plenum guide portion 1916*a*. The plenum guide portion 1916*a* functions as a passage through which the refrigerant of the first discharge chamber D1 flows into the second discharge chamber D2. In particular, the refrigerant in the first discharge chamber D1 may flow forward along the plenum guide portion 1916*a* in the axial direction.

In addition, the plenum extension portion 1916 may extend axially rearward to be in contact with the spring assembly 163. In detail, the rear end portion of the plenum extension portion 1916 in the axial direction can be in contact with the front surface of the spring support portion 165. In other words, the plenum extension portion 1916 may extend axially rearward than the second plenum seating portion 1912*b*.

The fixing ring 193 is inserted into the inner circumferential surface of the discharge plenum 191. Accordingly, it is possible to prevent the discharge plenum 191 from being separated from the discharge cover 200. In other words, the fixing ring 193 can be understood as a configuration for fixing the discharge plenum 191. In particular, the fixing ring 193 may be inserted into the inner circumferential surface of the plenum main body 1914 in a press pitting manner.

The fixing ring 193 is formed in a cylindrical shape having opened front surface and rear surface in the axial direction as a whole. Specifically, the fixing ring 193 includes a fixing ring main body 1930 which is in close contact with the inner circumferential surface of the discharge plenum 191 and first and second fixing ring extension portions 1932 and 1934 which extend from the fixing ring main body 1930 in the radial direction.

The fixing ring main body 1930 is installed in close contact with the first plenum main body 1914*a*. In addition, the axial length of the fixing ring main body 1930 may correspond to the axial length of the first plenum main body 1914*a*.

The first fixing ring extension portion 1932 extends inward in the radial direction at the front end portion of the fixing ring main body 1930 in the axial direction. Accordingly, the first fixing ring extension portion 1932 may be in close contact with the second plenum main body 1914*b*. The radial length of the first fixing ring extension portion 1932 is shorter than the radial length of the second plenum main body 1914*b*. In other words, the first fixing ring extension portion 1932 is installed in close contact with a portion of the second plenum main body 1914*b*.

The second fixing ring extension portion 1934 extends outward in the radial direction at the rear end portion of the fixing ring body 1930 in the radial direction. Accordingly, the second fixing ring extension portion 1934 can be in close contact with the second plenum seating portion 1914*b*. In detail, the second fixing ring extension portion 1934 may be in close contact with the connection portion between the first plenum main body 1914*a* and the second plenum seating portion 1914*b*.

In addition, the second fixing ring extension portion 1934 may be in close contact with the front surface of the spring assembly 163. In other words, the second fixing ring extension portion 1934 is disposed between the spring assembly 163 and the discharge plenum 191.

The fixing ring 193 may be formed of a material having a thermal expansion coefficient larger than that of the discharge plenum 191. For example, the fixing ring 193 is formed of stainless steel, and the discharge plenum 191 is formed of an engineering plastic material.

At this time, the fixing ring 193 may be formed to have a predetermined assembly tolerance with the discharge plenum 191 at room temperature. In detail, the fixing ring 193 is manufactured such that the outer diameter of the fixing ring main body 1930 is smaller than the inner diameter of the first plenum main body 1914*a* at room temperature. Accordingly, the fixing ring 193 can be relatively easily coupled to the discharge plenum 191.

When the linear compressor 10 is started, the discharge plenum 191 and the fixing ring 193 are expanded by receiving heat from the refrigerant discharged from the compression space P. At this time, the fixing ring 193 is expanded more than the discharge plenum 191 and can be brought into close contact with the discharge plenum 191. Accordingly, the discharge plenum 191 can be firmly in close contact with the discharge cover 200.

In addition, the discharge ring 193 is firmly brought into close contact with a side of the discharge cover 200 by the fixing ring 193 so that the leakage of the refrigerant between the discharge cover 200 and the discharge plenum 191 can be prevented.

Hereinafter, the flow of the refrigerant discharged in the compression space P will be described in detail based on this configuration.

FIG. 7 is a sectional view taken along line VII-VII' of FIG. 4. For the convenience of explanation, FIG. 7 also illustrates the discharge valve assembly 160 together with the discharge unit 190.

As illustrated in FIG. 7, the discharge space D is divided into a plurality of spaces. As described above, the discharge space D includes the first discharge chamber D1, the second discharge chamber D2, and the third discharge chamber D3. The refrigerant discharged in the compression space P may pass through the first discharge chamber D1, the second discharge chamber D2, and the third discharge chamber D3 in order.

In addition, the discharge space D is formed by the discharge cover 200 and the discharge plenum 191. The first discharge chamber D1 is formed by the discharge plenum 191 and the second and third discharge chambers D2 and D3 are formed between the discharge plenum 191 and the discharge cover 200. In addition, the second discharge chamber D2 is formed on the front side of the first discharge chamber D1 in the axial direction and the third discharge chamber D3 is formed on the outside of the first and second discharge chambers D1 and D2 in the radial direction.

Further, the discharge cover 200, the discharge plenum 191, and the fixing ring 193 are in close contact with each other and coupled to each other. The discharge valve assembly 160 may be seated at the rear end of the discharge plenum 191.

When the pressure in the compression space P becomes equal to or higher than the discharge pressure, the valve spring 164 is elastically deformed toward the discharge plenum 191. The discharge valve 161 opens the compression space P so that the compressed refrigerant in the compression space P can flow into the discharge space D. The refrigerant discharged from the compression space P by the opening of the discharge valve 161 passes through the valve spring 164 and is guided to the first discharge chamber D1.

The refrigerant guided to the first discharge chamber D1 is guided to the second discharge chamber D2 through the plenum guide portion 1916*a*. At this time, the refrigerant in the first discharge chamber D1 passes through the plenum guide portion 1916*a* having a narrow sectional area and then is discharged to the second discharge chamber D2 having a large sectional area. Thereby, the noise due to the pulsation of the refrigerant can be remarkably reduced.

The refrigerant guided to the second discharge chamber D2 is axially rearward moved along the first guide groove 2231 and is moved in the circumferential direction along the second guide groove 2233. The refrigerant moved in the circumferential direction along the second guide groove 2233 passes through the third guide groove 2235 and is guided to the third discharge chamber D3.

At this time, the refrigerant in the second discharge chamber D2 passes through the first guide groove 2231, the second guide groove 2233, and the third guide groove 2235 having a narrow sectional area, and is discharged to the third discharge chamber D3 having a wide sectional area. Thereby, the noise due to the pulsation of the refrigerant can be reduced once more.

The refrigerant guided to the third discharge chamber D3 is guided to the cover pipe 195. The refrigerant guided to the cover pipe 195 may be discharged to the outside of the linear compressor 10 through the discharge pipe 105.

As such, the refrigerant discharged in the compression space P may flow into the discharge unit 190. At this time, the refrigerant discharged in the compression space P corresponds to the refrigerant gas at a very high temperature. Therefore, the discharge unit 190 in which the refrigerant discharged in the compression space P flows can be maintained at a relatively high temperature.

At this time, the discharge cover 200 is disposed in combination with the frame 110. Accordingly, the heat of the discharge cover 200 can be conducted to the frame 110. Since the conduction of the heat is proportional to the contact area, the amount of heat conducted to the frame 110 may vary according to the area of the flange contact surfaces 2107 and 2117 described above.

Hereinafter, the discharge cover 200 and the frame 110 will be described in detail.

Figure 8:
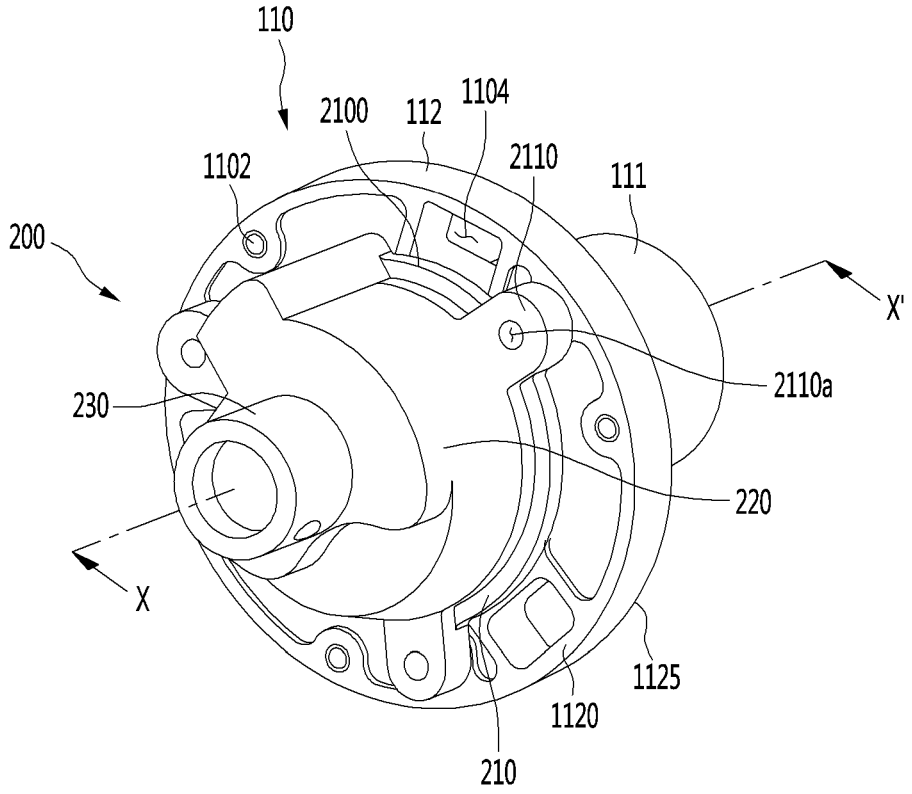
FIG. 8 is a view illustrating a discharge cover and a frame of a linear compressor according to an embodiment of the present invention.
Figure 9:
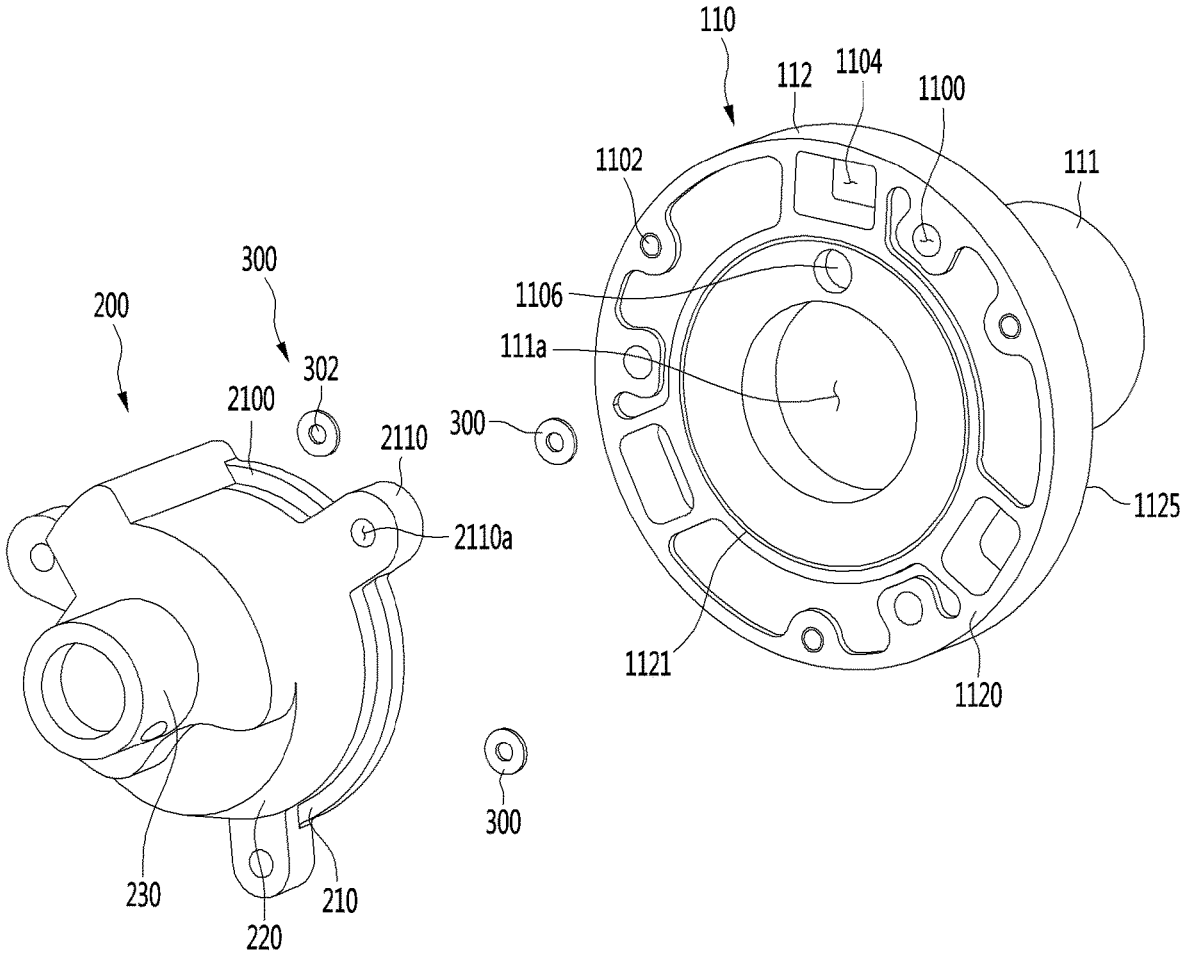
FIG. 9 is an exploded view illustrating a discharge cover and a frame of a linear compressor according to an embodiment of the present invention.
Figure 10:
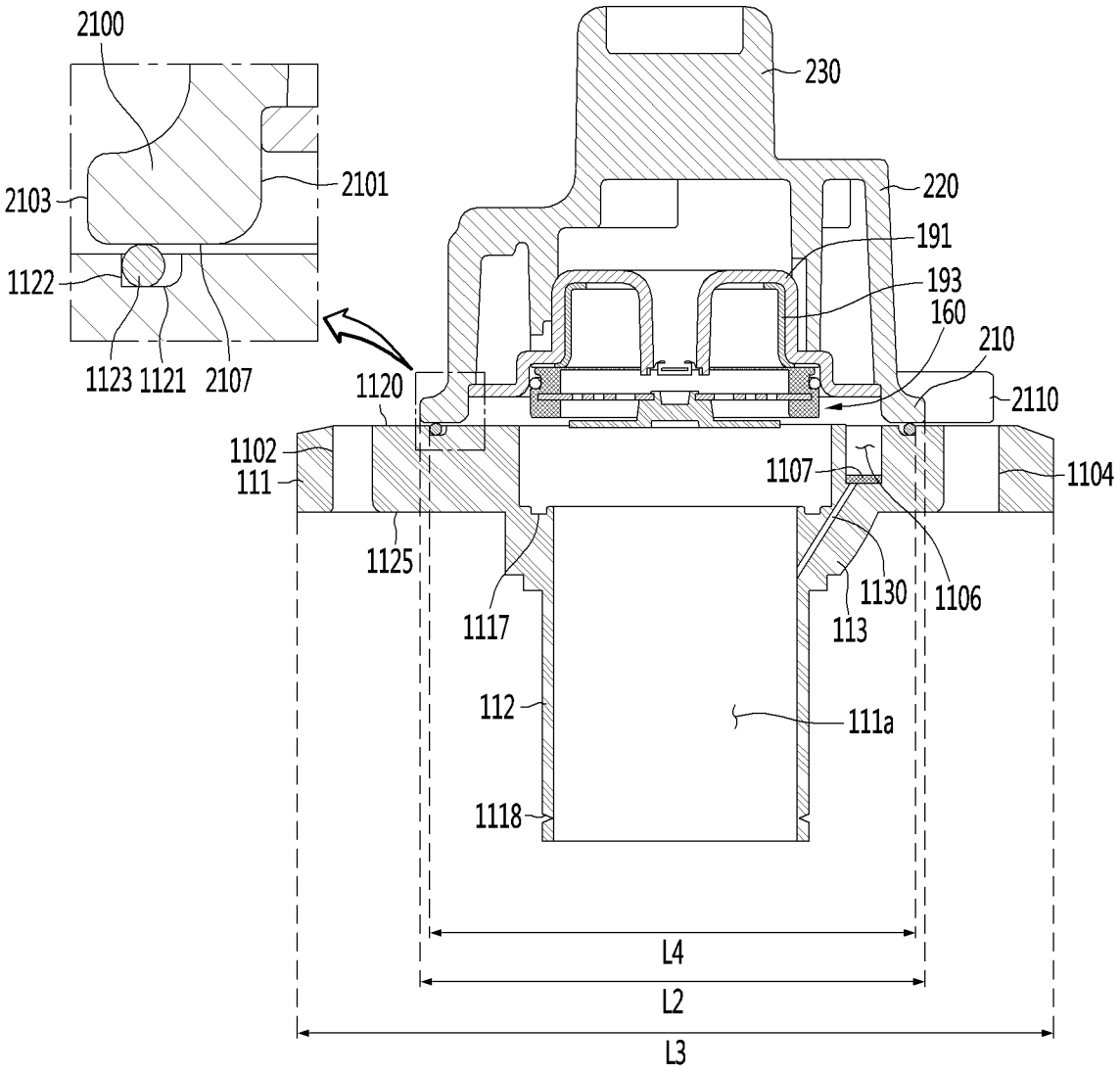
FIG. 10 is a sectional view taken along line X-X' in FIG. 8.

FIG. 8 is a view illustrating a discharge cover and a frame of a linear compressor according to an embodiment of the present invention, FIG. 9 is an exploded view illustrating a discharge cover and a frame of a linear compressor according to an embodiment of the present invention, and FIG. 10 is a sectional view taken along line X-X' in FIG. 8.

As illustrated in FIGS. 8 to 10, the discharge cover 200 and the frame 110 may be coupled to each other. At this time, a fastening member for coupling the discharge cover 200 and the frame 110 is omitted.

In addition, the linear compressor 10 includes a gasket 300 disposed between the frame 110 and the discharge cover 200. Particularly, the gasket 300 may be positioned at a portion where the frame 110 and the discharge cover 200 are fastened. In other words, it is understood that the gasket 300 is configured to fasten the frame 110 and the discharge cover 200 more tightly.

The gasket 300 is provided in the shape of a ring having a gasket through-hole 302 formed at the center thereof. The gasket through-hole 302 may have a size corresponding to the flange fastening hole 2110*a*. In addition, the outer diameter of the gasket 300 may be smaller than the outer diameter of the flange coupling portion 2110. Accordingly, when the gasket through-hole 302 is disposed so as to coincide with the flange fastening hole 2110*a*, the gasket 300 may be positioned inside the flange coupling portion 2110.

In addition, a plurality of gaskets 300 may be provided. In particular, a plurality of gaskets 300 are provided in number and position corresponding to the flange fastening holes 2110*a*. In other words, the plurality of gaskets 300 may be provided in three spaced apart by 120 degrees in the circumferential direction.

The frame 110 includes a frame main body 111 extending in the axial direction and a frame flange 112 extending outwardly from the frame main body 111 in the radial direction. At this time, the frame main body 111 and the frame flange 112 may be integrally formed with each other.

The frame main body 111 is provided in a cylindrical shape with an opened upper end and an opened lower end in the axial direction. In addition, the frame main body 111 is provided with a cylinder accommodation portion 111*a* in which the cylinder 120 is accommodated therein. Accordingly, the cylinder 120 is accommodated in the inner side of the frame main body 111 in the radial direction and at least a portion of the piston 130 is accommodated inside the cylinder 120 in the radial direction.

In addition, the frame main body 111 is formed with sealing member insertion portions 1117 and 1118. The sealing member insertion portion includes a first sealing member insertion portion 1117 which is formed in the frame main body 111 and into which the first sealing member 129*a* is inserted. In addition, the sealing member insertion portion includes a second cylinder sealing member insertion portion 1118 which is formed on an outer circumferential surface of the frame main body 111 and into which the second sealing member 129*b* is inserted.

In addition, the inner stator 148 is coupled to the outer side of the frame main body 111 in the radial direction. In addition, the outer stator 141 is disposed on the outer side of the inner stator 148 in the radial direction and the permanent magnet 146 is disposed between the inner stator 148 and the outer stator 141.

The frame flange 112 is provided in a disc shape having a predetermined thickness in the axial direction. In detail, the frame flange 112 is provided in a ring shape having a predetermined thickness in the axial direction due to the cylinder accommodation portion 111*a* provided on the center side in the radial direction.

In particular, the frame flange 112 extends at the front end portion of the frame main body 111 in the radial direction. Accordingly the inner stator 148, the permanent magnet 146, and the outer stator 141 disposed outward of the frame main body 111 in the radial direction are disposed rearward of the frame flange 112 in the axial direction.

Further, the frame flange 112 is formed with a plurality of openings which pass through in the axial direction. At this time, the plurality of openings include a discharge fastening hole 1100, a stator fastening hole 1102, and a terminal insertion hole 1104.

A predetermined fastening member (not illustrated) for fastening the discharge cover 200 and the frame 110 is inserted into the discharge hole 1100. In detail, the fastening member (not illustrated) may be inserted into the front side of the frame 110 through the discharge cover 200.

Accordingly, the discharge fastening holes 1100 may be provided in the size, number, and position corresponding to the flange fastening holes 2110*a*. In other words, the flange fastening hole 2110*a*, the discharge fastening hole 1100, and the gasket through-hole 302 are provided in corresponding sizes, numbers, and positions. Further, the flange fastening hole 2110*a*, the gasket through-hole 302, and the discharge fastening hole 1100 are disposed in order from the upper side to the lower side in the axial direction.

The cover fastening member 149*a* described above is inserted into the stator fastening hole 1102. The cover fastening member 149*a* can couple the stator cover 149 with the frame 110 and fix the outer stator 141 disposed between the stator cover 149 and the frame 110 in the axial direction.

The terminal insertion hole 1104 is inserted with the terminal portion 141*d* of the outer stator 141 described above. In other words, the terminal portion 141*d* may be penetrated from the rear side to the front side of the frame 110 through the terminal insertion hole 1104 to be drawn out or exposed to the outside.

At this time, a plurality of the discharge connection holes 1100, a plurality of the stator fastening holes 1102, and a plurality of the terminal insertion holes 1104 may be provided, and may be spaced apart from each other and disposed in order in the circumferential direction. For example, the discharge fastening hole 1100, the stator fastening hole 1102, and three terminal insertion holes 1104 may be provided and may be disposed at intervals of 120 degrees in the circumferential direction.

Further, the terminal insertion hole 1104, the discharge fastening hole 1100, and the stator fastening hole 1102 are disposed in a state of being spaced apart from each other in the order in the circumferential direction. Further, the terminal insertion hole 1104, the discharge fastening hole 1100, and the stator fastening hole 1102 may be disposed in a state of being spaced apart from each other at intervals of 30 degrees in the circumferential direction between adjacent openings.

For example, each of the terminal insertion holes 1104 and the discharge fastening hole 1100 is disposed in a state of being spaced apart from each other at intervals of 30 degrees in the circumferential direction. Further, each of the discharge fastening holes 1100 and the stator fastening holes 1102 are disposed at intervals of 30 degrees in the circumferential direction. Meanwhile, each of the terminal insertion holes 1104 and the stator fastening holes 1102 are disposed in a state of being spaced apart from each other at intervals of 60 degrees in the circumferential direction.

Each disposition is based on the circumferential center of the terminal insertion hole 1104, the discharge fastening hole 1100, and the stator fastening hole 1102.

At this time, the front surface of the frame flange 112 is referred to as a discharge frame surface 1120, and the rear surface is referred to as a motor frame surface 1125. In other words, the discharge frame surface 1120 and the motor frame surface 1125 correspond to axially opposed surfaces. In detail, the discharge frame surface 1120 corresponds to a surface in contact with the discharge cover 200. In addition, the motor frame surface 1125 corresponds to the surface adjacent to the motor assembly 140.

A seal member insertion portion 1121 into which the discharge sealing member 1123 is inserted is formed in the discharge frame surface 1120. In detail, the sealing member insertion portion 1121 is formed in a ring shape and recessed rearward on the discharge frame face 1120 in the axial direction.

In addition, the discharge sealing member 1123 is provided in a ring shape having a diameter corresponding to the sealing member insertion portion 1121. The discharge sealing member 1123 can prevent the refrigerant from flowing between the discharge cover 200 and the frame 110.

In addition, a gas hole 1106 communicating with a gas passage 1130, which will be described later, is formed on the discharge frame surface 1120. The gas holes 1106 are formed to be rearward recessed from the discharge frame surface 1120 in the axial direction. In addition, the gas hole 1106 may be equipped with a gas filter 1107 for filtering the foreign substances of the flowing gas. At this time, the gas holes 1106 are formed inward of the sealing member insertion portions 1121 in the radial direction.

In addition, the terminal insertion hole 1104, the discharge fastening hole 1100, and the stator fastening hole 1102 are formed in the discharge frame surface 1120. In addition, the terminal insertion hole 1104, the discharge fastening hole 1100, and the stator fastening hole 1102 are formed outwardly of the sealing member insertion portion 1121 in the radial direction.

Particularly, the terminal insertion hole 1104, the discharge fastening hole 1100, and the stator fastening hole 1102 are formed to penetrate to the motor frame surface 1125 in the axial direction. In other words, the terminal insertion hole 1104, the discharge fastening hole 1100, and the stator fastening hole 1102 are formed in the same manner on the discharge frame surface 1120 and the motor frame surface 1125.

In addition, referring to FIGS. 8 and 9, a predetermined recessed structure may be formed on the discharge frame surface 1120. In order to prevent the heat of the discharge refrigerant from being transferred, there is no limitation on the recessed depth and the recessed shape. For the convenience of description, FIG. 10 does not illustrate such a recessed structure.

In addition, the frame 110 includes a frame connection portion 113 extending obliquely from the frame flange 112 toward the frame main body 111. A gas passage 1130 for guiding the refrigerant discharged from the discharge valve 161 to the cylinder 120 is formed in the frame connection portion 113.

The gas passage 1130 may be formed to be inclined as the frame connection portion 113. Specifically, one end of the gas passage 1130 is connected to the gas hole 1106, and the other end thereof is connected to the outer circumferential surface of the cylinder 120.

In addition, a gas inflow portion 1200 (see FIG. 3) recessed radially inward is formed on an outer circumferential surface of the cylinder 120 in contact with the gas passage 1130. In addition, the gas inflow portion 1200 may be formed along the outer circumferential surface of the cylinder 120 and a plurality of gas inflow portions 1200 which are axially spaced apart from each other may be provided. In addition, the gas inflow portion 1200 may extend to an inner circumferential surface of the cylinder 120, that is, to an outer circumferential surface of the piston 130.

Accordingly, a portion of the refrigerant discharged from the compression space P flows through the gas hole 1106. The portion of the refrigerant may flow into the gas inflow portion 1200 through the gas passage 1130 and may flow into the cylinder 120 and the piston 130.

The refrigerant flowing in this way provides a lifting force to the piston 130 to perform the function of the gas bearing for the piston 130. According to such an operation, wear of the piston 130 and the cylinder 120 can be prevented by performing the bearing function using at least a portion of the discharge refrigerant without using oil.

At this time, a plurality of the frame connection portions 113 are provided and are disposed at equal intervals in the circumferential direction. For example, three frame connection portions 113 are provided and may be formed at intervals of 120 degrees in the circumferential direction.

In addition, the gas passage 1130 may be formed only in one of the plurality of frame connection portions 113. At this time, it is understood that the remaining frame connection portion 113 is provided to prevent deformation of the frame 110.

At this time, the outer diameter of the discharge frame surface 1120 is referred to as a frame outer diameter L3. The discharge frame surface 1120 is a portion extending most outward in the radial direction of the frame 110 and the frame outer diameter L3 can be understood as the outer diameter of the frame 110.

In addition, the outer diameter of the sealing member insertion portion 1121 is referred to as a discharge sealing outer diameter L4. The sealing member insertion portion 1121 corresponds to a configuration formed by being recessed axially rearward from the discharge frame surface 1120. Accordingly, the discharge sealing outer diameter L4 can be understood as an outer end portion where the depression starts. At this time, the outer end portion of the sealing member insertion portion 1121 forming the discharging sealing outer diameter L4 is defined as a leakage preventing wire 1122.

At this time, the flange outer diameter L2 is smaller than the frame outer diameter L3 and larger than the discharge sealing outer diameter L4 (L4<L2<L3). Hereinafter, this will be described in detail.

Figure 11:
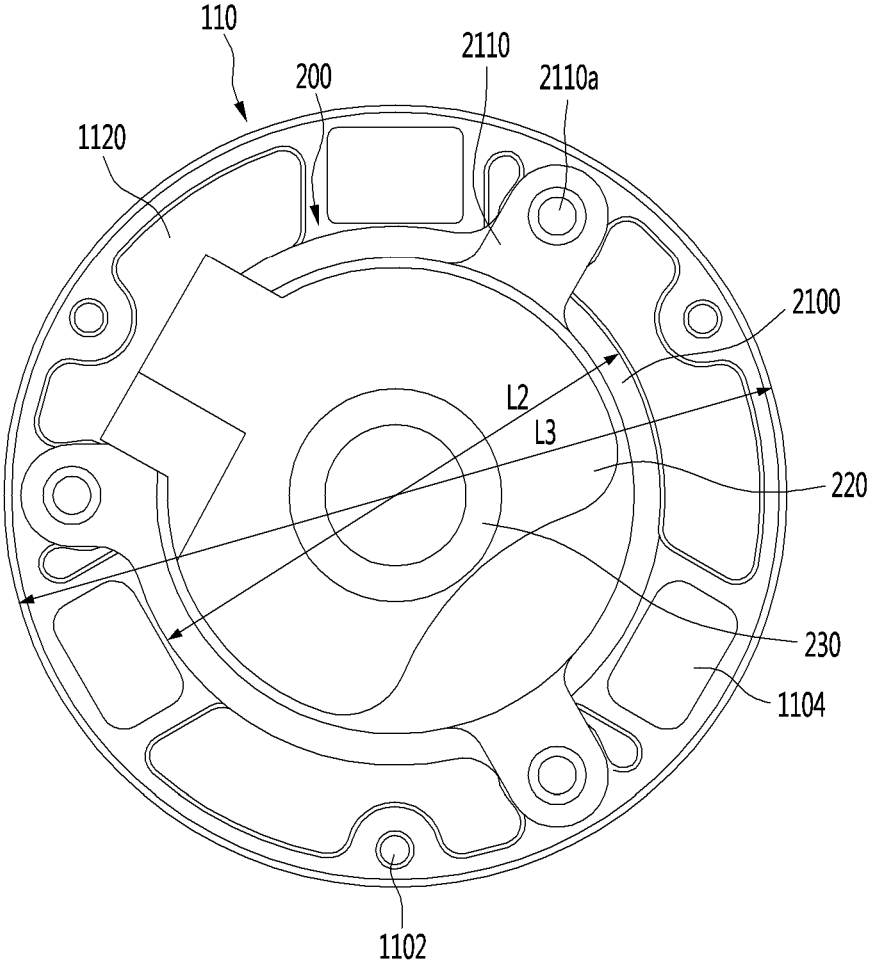
FIG. 11 is a front view illustrating a discharge cover and a frame of a linear compressor according to an embodiment of the present invention.
Figure 12:
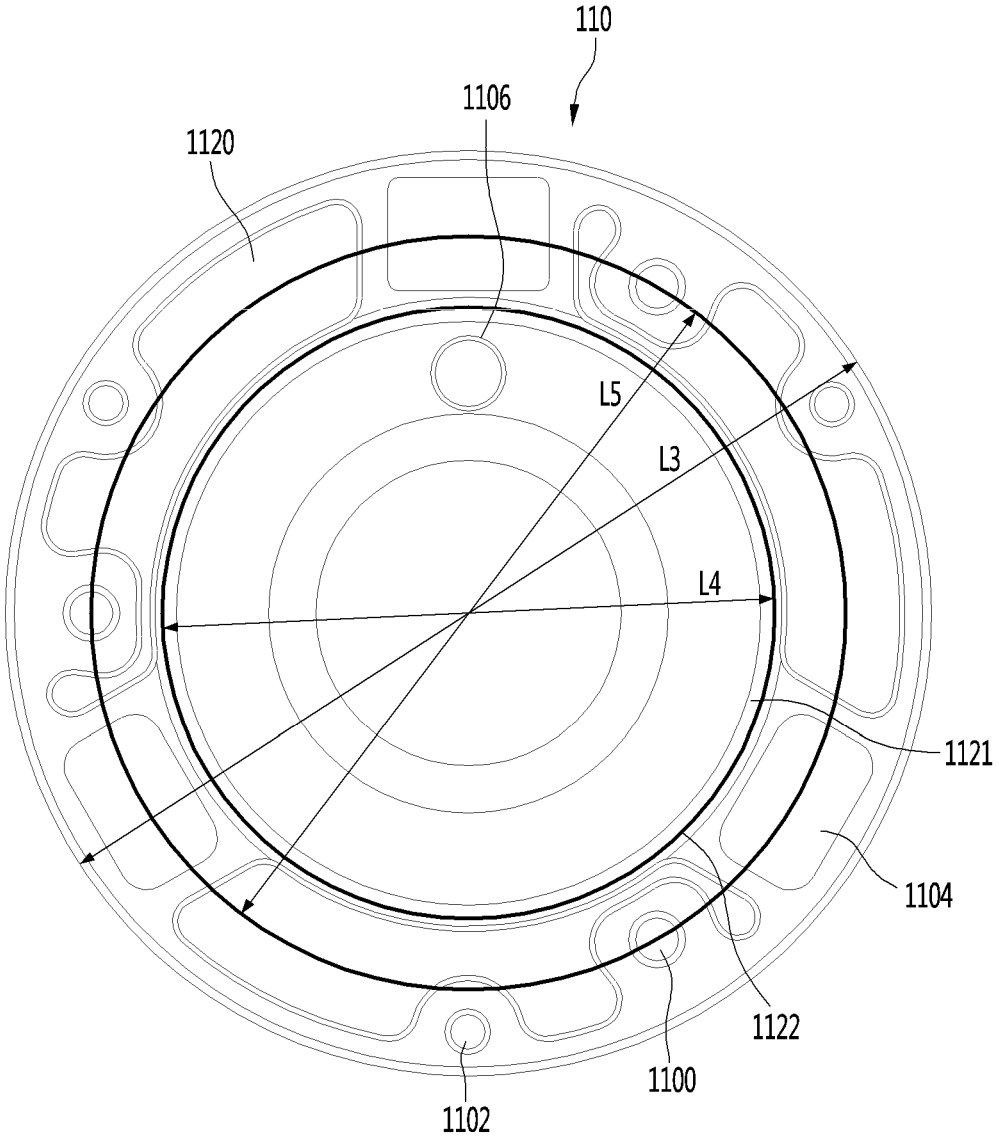
FIG. 12 is a view illustrating a range of a frame outer diameter in a frame of a linear compressor according to an embodiment of the present invention.

FIG. 11 is a front view illustrating a discharge cover and a frame of a linear compressor according to an embodiment of the present invention, and FIG. 12 is a view illustrating a range of a frame outer diameter in a frame of a linear compressor according to an embodiment of the present invention.

FIGS. 11 and 12 illustrate the frame 110 at the front side in the axial direction, and the front surface of the frame 110, that is, the discharge frame surface 1120 is illustrated. In addition, FIG. 11 illustrates a state where the discharge cover 200 is coupled and FIG. 12 illustrates a state where the discharge cover 200 is not coupled.

As described above, the frame 110 and the discharge cover 200 are coupled by a fastening member. Specifically, the discharge cover 200 is seated on the discharge frame surface 1120 such that the discharge fastening holes 1100 and the flange fastening holes 2110*a* are axially positioned in parallel with each other. The fastening member may be inserted into and coupled to the discharge fastening hole 1100 and the flange fastening hole 2110*a*.

At this time, the gasket 300 may be disposed between the frame 110 and the discharge cover 200. Specifically, the gasket 300 is disposed between the flange coupling portion 2110 and the discharge frame surface 1120 adjacent to the discharge fastening hole 1100. Particularly, the gasket through-hole 302 is disposed in parallel with the discharge fastening hole 1100 and the flange fastening hole 2110*a* in the axial direction.

Accordingly, the frame 110 and the discharge cover 200 are coupled to one surface to be in contact with each other. In detail, the discharge frame surface 1120 and the frame contact surfaces 2107 and 2117 are in contact with each other. At this time, the area of the discharge frame surface 1120 is larger than the area of the frame contact surfaces 2107 and 2117.

Accordingly, the discharge frame surface 1120 is divided into a surface which is in contact with the frame contact surfaces 2107 and 2117 and surfaces which are not in contact with the frame contact surfaces 2107 and 2117. For the convenience of explanation, the surface which is in contact with the frame contact surfaces 2107 and 2117 is referred to as a first surface and the surface which is not in contact with the frame contact surfaces 2107 and 2117 is referred to as a second surface.

The first surface is a surface with which the frame 110 and the discharge cover 200 are in contact and Heat conduction is generated at the first surface. Since the discharge refrigerant having a very high temperature flows into the discharge cover 200, the heat of the discharge cover 200 is conducted to the frame 110. The temperature of the frame 110 can be raised by the heat conduction.

At this time, the frame 110 corresponds to a configuration to which the cylinder 120 and the piston 130 are coupled. Accordingly, when the temperature of the frame 110 is raised, the temperatures of the cylinder 120 and the piston 130 may be increased. As a result, the temperature of the suction refrigerant flowing into the piston 130 rises and the compression efficiency is lowered.

Therefore, in order to increase the compression efficiency, there is a need to minimize the heat conducted to the frame 110. In other words, since the conduction heat transfer is proportional to the contact area, it is necessary to minimize the first surface.

The second surface corresponds to a surface of the frame 110 exposed to the inside of the shell 101. At this time, the inside of the shell 101 is filled with refrigerant, and the temperature of the refrigerant (hereinafter, shell refrigerant) is similar to the temperature of the suction refrigerant. As described above, the frame 110 has a relatively high temperature because the heat is conducted in the discharge cover 200.

Thereby, heat transfer from the frame 110 to the shell refrigerant occurs through the second surface. In other words, the heat of the frame 110 is dissipated to the shell refrigerant by a convention. At this time, the temperature of the frame 110 may decrease as the amount of heat to be dissipated increases.

Therefore, in order to increase the compression efficiency, it is necessary to maximize the convection heat in the frame 110. In other words, since convective heat transfer is proportional to the contact area, it is necessary to maximize the second surface.

In summary, the temperature of the frame 110 can be effectively lowered in a case where the first surface is minimized and the second surface is maximized. At this time, in a case where the area of the discharge frame surface 1120 is fixed, the frame contact surfaces 2107 and 2117 may be minimized to maximize the second surface.

At this time, the flange contact surfaces 2107 and 2117 include the coupling contact surface 2117 and the main body contact surface 2107. Since the coupling contact surface 2117 is constrained to the position of the discharge coupling hole 1100, it is difficult to minimize the coupling contact surface 2117.

Accordingly, the main body contact surface 2107 can be minimized to maximize the second surface. At this time, since the main body contact surface 2107 is formed in a circular shape having the flange outer diameter L2, it is necessary to minimize the flange outer diameter L2.

However, in a case where the flange outer diameter L2 is formed too small, a problem may arise in reliability. For example, the coupling between the frame 110 and the discharge cover 200 may become unstable or deformation of the discharge cover 200 may occur.

Therefore, the flange outer diameter L2 of the linear compressor 10 according to the idea of the present invention may be smaller than the frame outer diameter L3 and larger than the discharge sealing outer diameter L4 (L4<L2<L3).

In particular, the flange outer diameter L2 may be 0.6 to 0.9 times the outer diameter of the frame L3 (0.6*L3<L2<0.9*L3). In other words, the ratio (L2/L3) of the flange outer diameter L2 to the frame outer diameter L3 corresponds to 0.6 to 0.9. This is a numerical value considering reliability and efficiency.

Referring to FIG. 12, the flange outer diameter L2 is larger than the discharge sealing outer diameter L4 and is smaller than the diameter L5 of the imaginary circle formed by the discharge fastening hole 1100 (L4<L2<L3). At this time, the imaginary circle corresponds to a circle connecting the center axis of the discharge hole 1100 in the circumferential direction. Alternatively, the imaginary circle may be a circle obtained by connecting the center axis of the flange fastening hole 2110*a* in the circumferential direction.

In FIG. 12, the discharge sealing outer diameter L4 and the diameter L5 of the imaginary circle are illustrated by thick lines. Therefore, the flange outer diameter L2 can be formed between the discharge sealing outer diameter L4 and the diameter L5 of the imaginary circle, that is, between the thick lines.

In a case where the flange outer diameter L2 is smaller than the discharge sealing outer diameter L4, the discharge sealing member 1123 is exposed to the outside of the main body contact surface 2107. Accordingly, the discharge sealing member 1123 does not function, and the refrigerant may leak between the frame 110 and the discharge cover 200.

Therefore, in order to prevent this, the flange outer diameter L2 should be larger than the discharge sealing outer diameter L4. The discharge sealing outer diameter L4 may be 0.6 to 0.65 times the frame outer diameter L3. Therefore, the flange outer diameter L2 may be formed larger than 0.6 times the frame outer diameter L3.

In addition, in a case where the flange outer diameter L2 is larger than the imaginary circle L5, the area of the discharge frame surface 1120 exposed to the shell refrigerant may not be sufficient. Accordingly, heat radiation to the shell refrigerant in the frame 110 may not be effectively generated.

Therefore, in order to prevent this, the flange outer diameter L2 may be smaller than the diameter L5 of the imaginary circle. The diameter L5 of the imaginary circle may be 0.8 to 0.9 times the frame outer diameter L3. Therefore, the flange outer diameter L2 may be smaller than 0.9 times the frame outer diameter L3.

However, such limitations are proposed for the purpose of increasing heat transfer. In other words, the flange outer diameter L2 may be larger than the diameter L5 of the imaginary circle. Therefore, the maximum size of the flange outer diameter L2 may be formed differently as an example.

As described above, the flange outer diameter L2 may be formed such that the area of the discharge frame surface 1120 in contact with the shell refrigerant is maximized. Accordingly, the heat transmitted to the frame 110 is minimized, and the heat dissipated in the frame 110 can be maximized. In other words, the temperature of the frame 110 is lowered and the compression efficiency can be maximized.

What is claimed is:

1. A linear compressor comprising:

a cylinder that defines a compression space configured to receive refrigerant;

a frame that accommodates at least a portion of the cylinder; and a discharge unit that defines a discharge space configured to receive the refrigerant discharged from the compression space, the discharge unit being configured to allow the refrigerant discharged from the compression space to flow through the discharge space, wherein the discharge unit comprises a discharge cover coupled to the frame and a discharge plenum disposed inside the discharge cover, the discharge cover comprising:

a cover flange portion that faces a front surface of the frame in an axial direction of the cylinder, a chamber portion that extends forward from the cover flange portion in a direction away from the front surface of the frame in the axial direction, and a partition sleeve that is disposed inside the chamber portion and has a cylindrical shape, the partition sleeve partitioning an inner space of the chamber portion, wherein the discharge plenum is inserted into the partition sleeve, wherein the cover flange portion comprises:

a flange main body that has a ring shape defining a flange inner diameter and a flange outer diameter, and a flange coupling portion that extends outward from the flange main body in a radial direction of the cylinder and defines a flange fastening hole configured to receive a coupling member to couple the discharge cover to the frame, wherein the flange main body comprises:

a main body penetration portion that defines a first circumferential portion of a circular opening that defines the flange inner diameter, a main body extension portion that extends outward from the main body penetration portion in the radial direction, the main body extension portion having a circular outer appearance that defines the flange outer diameter, a main body contact surface that is disposed at the main body extension portion and contacts the front surface of the frame, and a main body connection portion that is opposite to the main body contact surface in the axial direction and that is connected to the chamber portion, wherein the main body extension portion defines a flange main body thickness that is a distance between the main body contact surface and the main body connection portion in the axial direction, wherein the flange coupling portion comprises:

a coupling penetration portion that defines a second circumferential portion of the circular opening, a coupling extension portion that extends outward from the coupling penetration portion in the radial direction and that defines the flange fastening hole, the coupling extension portion protruding outward relative to the main body extension portion in the radial direction, a coupling contact surface that is disposed at the coupling extension portion and contacts the front surface of the frame, and a coupling connection portion that is opposite to the coupling contact surface in the axial direction and that is connected to the chamber portion, wherein the coupling extension portion defines a flange coupling portion thickness that is a distance between the coupling contact surface and the coupling connection portion in the axial direction, and wherein the flange coupling portion thickness is greater than the flange main body thickness.

2. The linear compressor of claim 1, wherein the main body contact surface and the coupling contact surface are connected to each other and define a planar surface that extends in the radial direction.

3. The linear compressor of claim 1, wherein a circumferential length of the main body extension portion is greater than a circumferential length of the coupling extension portion.

4. The linear compressor of claim 1, wherein a center of the flange fastening hole is positioned outward of the main body extension portion in the radial direction.

5. The linear compressor of claim 1, wherein the cover flange portion further comprises a plurality of coupling extension portions that protrude radially outward from portions of the main body extension portion and that are spaced apart from one another in a circumferential direction of the discharge cover, the coupling extension portion being one of the plurality of coupling extension portions.

6. The linear compressor of claim 1, wherein the partition sleeve protrudes from an inner surface of the chamber portion toward the discharge plenum and has an inner circumferential surface that faces the discharge plenum, and wherein the inner circumferential surface of the partition sleeve defines a plurality of guide grooves comprising:

a first guide groove spaced apart from an outer surface of the discharge plenum, and a second guide groove in contact with the outer surface of the discharge plenum.

7. The linear compressor of claim 1, wherein the main body contact surface and the coupling contact surface are connected to each other and define one planar surface that extends in the radial direction, and wherein the coupling connection portion and the main body connection portion are connected to each other and define a stepped portion disposed between the coupling connection portion and the main body connection portion.

8. The linear compressor of claim 1, wherein the discharge plenum is inserted into the discharge cover through the main body penetration portion.

9. The linear compressor of claim 1, wherein the cover flange portion comprises a plurality of flange coupling portions that extend outwardly from the main body penetration portion in the radial direction.

10. The linear compressor of claim 9, wherein the plurality of flange coupling portions are spaced apart from one another in a circumferential direction of the discharge cover and define a plurality of flange fastening holes including the flange fastening hole, and wherein the plurality of flange fastening holes are equally spaced apart from one another in the circumferential direction.

11. The linear compressor of claim 1, wherein the discharge plenum is coupled to the discharge cover and defines a plurality of discharge spaces together with the discharge cover, wherein the plurality of discharge spaces comprise:

a first discharge chamber defined inside of the discharge plenum, a second discharge chamber defined between the discharge cover and the discharge plenum and disposed forward of the first discharge chamber in the axial direction, and a third discharge chamber defined between the discharge cover and the discharge plenum and disposed outward of the first discharge chamber and the second discharge chamber in the radial direction.

12. The linear compressor of claim 11, further comprising a cover pipe coupled to the discharge cover and configured to communicate with the third discharge chamber, wherein the cover pipe is configured to receive, through the first discharge chamber, the second discharge chamber, and the third discharge chamber, the refrigerant discharged from the compression space.

* * * * *